US006583774B1

(12) United States Patent
Yoshida et al.

(10) Patent No.: US 6,583,774 B1
(45) Date of Patent: Jun. 24, 2003

(54) DISPLAY DEVICE

(75) Inventors: Yasuhiro Yoshida, Nara (JP); Yoichi Yamamoto, Nara (JP); Satoshi Ueno, Tenri (JP)

(73) Assignee: Sharp Kabushiki Kaisha, Osaka (JP)

( * ) Notice: Subject to any disclaimer, the term of this patent is extended or adjusted under 35 U.S.C. 154(b) by 167 days.

(21) Appl. No.: 09/630,997

(22) Filed: Aug. 2, 2000

(30) Foreign Application Priority Data

| | | |
|---|---|---|
| Aug. 5, 1999 | (JP) | 11-221911 |
| Jun. 12, 2000 | (JP) | 2000-175808 |
| Jun. 13, 2000 | (JP) | 2000-176697 |

(51) Int. Cl.[7] ..... G09G 3/20

(52) U.S. Cl. ..... 345/55; 345/214; 345/690; 345/88

(58) Field of Search ..... 345/214, 87, 904, 345/101, 55, 88, 89, 690, 589, 593, 601, 603; 348/246, 247, 616, 615, 607; 382/252

(56) References Cited

U.S. PATENT DOCUMENTS

| | | | | |
|---|---|---|---|---|
| 4,701,784 A | * | 10/1987 | Matsuoka et al. | 358/163 |
| 5,504,504 A | * | 4/1996 | Markandey et al. | 345/214 |
| 5,623,281 A | * | 4/1997 | Markandey et al. | 345/108 |
| 6,028,628 A | * | 2/2000 | Van Der Valk | 348/246 |
| 6,104,839 A | * | 8/2000 | Cok et al. | 382/254 |

FOREIGN PATENT DOCUMENTS

| | | |
|---|---|---|
| JP | 235994/1988 | 9/1988 |
| JP | 154196/1989 | 6/1989 |
| JP | 329495/1997 | 12/1997 |
| KR | 199926575 | 4/1999 |

OTHER PUBLICATIONS

Chromatic Spatial Frequency Characteristics of Human Visual System (Color Difference Discrimination) by H. Sakata et al., The Journal of the Institute of Television Engineers of Japan, vol. 31, No. 1, pp. 29–35, 1976.

* cited by examiner

*Primary Examiner*—Dennis-Doon Chow
(74) *Attorney, Agent, or Firm*—David G. Conlin; William J. Daley, Jr.; Edwards & Angell, LLP

(57) ABSTRACT

A display device controls a signal applied to the n dots such that a sum of luminance of n dots (n is an integer of 1 or more) is virtually equal to an original luminance of the defective dot on the assumption that the n dots, which are adjacent to an electrically uncontrollable dot, are not originally illuminated. The display device also controls a signal applied to dots adjacent to the defective dot so as to display a color which is closer to an original color obtained by input signals to the defective dot and the adjacent dots.

33 Claims, 21 Drawing Sheets

EXAMPLE OF SPACIAL FREQUENCY PROPERTY ON CHROMATICITY AND COUNTRAST

DISPLAY DEVICE

FIELD OF THE INVENTION

The present invention relates to a display device having a pixel structure, that includes a liquid crystal display device (hereinafter, referred to as an LCD), a plasma display panel (hereinafter, referred to as a PDP), and the like. The display device is capable of making the existence of an electrically uncontrollable dot (hereinafter, referred to as a defective dot) more unnoticeable.

BACKGROUND OF THE INVENTION

When manufacturing a display device, in which dots of three colors constituting minute pixels of an LCD, a PDP, and the like are spaciously arranged, a defective dot appears out of several millions dots. Such a defective dot cannot control intensity of light, so that a pixel including the dot cannot freely develop a color. Therefore, even in the event of a defect at an extremely small rate, e.g., one out of several million pixels, picture quality is seriously affected. For this reason, such a display device requires strict screening before delivery, resulting in a problem such as an increase in overall cost and an obstacle to wide use.

FIG. 7 is an explanatory drawing showing a model of display device having a defective dot. In FIG. 7, dots 201 represent red, dots 202 represent blue, dots 203 represent green, 204 represents a black matrix, and the colors are aligned in longitudinal stripes. In FIG. 7, hatched parts are illuminated parts. Namely, FIG. 7 shows an enlarged part of the surface entirely illuminated in blue on the display device. The following explanation is made on the assumption that only the blue dots 202 are entirely illuminated.

Assuming that a blue dot 205 is defective and is shown as a black dot, although the entire surface needs to be illuminated in blue, the defective dot cannot be illuminated. Consequently, irregular colors appear on the surface so as to cause deterioration in picture quality.

As for such a defective dot, the fundamental solution is to improve its manufacturing technique. For example, a method of improving the precision and cleaning a manufacturing apparatus is applicable.

Another method is applicable, in which a circuit pattern, etc. is modified for correcting a defective dot found in inspection after manufacturing. When a defective dot can undergo some processing after manufacturing, a method has been adopted in which the circuit is burned off and sintered using a laser device to make the defective dot more unnoticeable.

Conventionally, the foregoing two methods have been mainly adopted. To be specific, the manufacturing technology is improved, or a processing is performed after manufacturing, so that a reduction of a defective ratio is achieved, thereby reducing the overall cost.

However, the conventional methods require a large amount of cost. For example, when introducing equipment with high ability of cleaning, the cost is extremely large. Further, it is also costly to maintain the cleaning ability.

Moreover, regarding the method of making a defective dot unnoticeable by burning off or sintering a circuit with a laser device, etc., the following problems occur:

Firstly, the result of the method cannot be freely selected. To be specific, the laser device has only two alternatives of burning off or sintering the circuit, so that it is only possible to permanently make the defective dot non-conductive or bring it into conduction. Therefore, the defective dot is entirely illuminated (luminescent spot defect) or unilluminated (black spot defect). Only a few defects can be solved by the foregoing methods; hence, the foregoing technique by itself cannot dramatically reduce the overall defective ratio.

Next, the methods have an extremely small throughput, which means that long time is required to analyze the content of a defect, to judge which circuit and how it should be burned off or sintered, and to perform the operation. For this reason, the foregoing methods cannot efficiently reduce defects.

Considering the above two problems, even when the foregoing methods are used with the laser device, it is fairly impossible to dramatically reduce an overall defective ratio.

Consequently, either improvement of the manufacturing technique or the method using a laser device, etc. requires a large amount of cost, resulting in a problem such as an increase in the overall cost.

SUMMARY OF THE INVENTION

The objective of the present invention is to provide a display device which is can suppress a display defect caused by a defective dot, which is electrically uncontrollable, in a desirable manner, and which can decrease the cost for correcting a defect.

Another objective of the present invention is to provide a display device which can further simplify its circuit construction.

In order to attain the above objectives, the display of the present invention, in which dots of three colors constituting a fine pixel are spatially arranged, includes a means for controlling a signal applied to a dot adjacent to an electrically uncontrollable dot, in order to reduce visual deterioration caused by the electrically uncontrollable dot.

According to the above invention, even when a defective dot, which is electrically uncontrollable, occurs in the display device, it is possible to generate brightness substantially equal to original brightness of the defective dot, by controlling a signal applied to one or more dots adjacent to the defective dot. Consequently, it is possible to suppress visual deterioration (display defect) caused by the defective dot. Moreover, the present invention does not cause the foregoing problems that appear in the conventional method using a laser device.

Here, "adjacent to . . . " means that a dot is adjacent to the defective dot horizontally, vertically, or diagonally.

In order to attain the foregoing objectives, another display device of the present invention, which has a plurality of pixels, each pixel displaying by dots of at least three colors, includes a control means for controlling a signal applied to a plurality of dots adjacent to the defective dot so as to reduce a difference between a) a color obtained by illumination of the plurality of dots and b) an original color obtained by input signals to the defective dot and the plurality of dots, in order to compensate for a display defect caused by the defective dot which is electrically uncontrollable, wherein the control means performs an operation based on a function, which is obtained by correlation relationship between an original input signal of the defective dot and a signal value to be applied to one of the plurality of dots in response to the input signal of the defective dot, so as to determine a signal value applied to the one of the plurality of dots, and then, the control means determines a signal value applied to another dot.

According to the present invention, signals applied to the plurality of dots are controlled such that a difference is reduced (preferably to a minimum) between a) a color obtained by illumination of the plurality of dots adjacent to a defective dot and b) an original color obtained by input signals to the defective dot and the plurality of dots. With this arrangement, a color around the defective dot is virtually equal to an original color of the defective dot, thereby suppressing a display defect caused by the defective dot. Further, the present invention does not cause the foregoing problems that appear in the conventional method using a laser device.

Furthermore, the control means performs an operation based on a function, which is obtained by a correlation relationship between an original input signal of the defective dot and a signal value to be applied to one of the plurality of dots in response to the input signal of the defective dot, so as to determine a signal value applied to the one of the plurality of dots. It is therefore possible to determine a signal value applied to the one of the dots by relatively simple operation, thereby simplifying the circuit construction.

The present invention is suitably adopted for a liquid crystal display device and so on. Additionally, the present invention is applicable to the other display devices such as a plasma display device and an electroluminescence display device. Moreover, the present invention is not limited to a display device for providing a color display with a single display panel but is also adopted for a projection display system (such as a liquid crystal projector) and the like, which is provided with a plurality of panels corresponding to colors and provides a color display by synthesizing light transmitted from the panels.

For a fuller understanding of the nature and advantages of the invention, reference should be made to the ensuing detailed description taken in conjunction with the accompanying drawings.

DESCRIPTION OF THE EMBODIMENTS

EMBODIMENT 1

Figure 1:
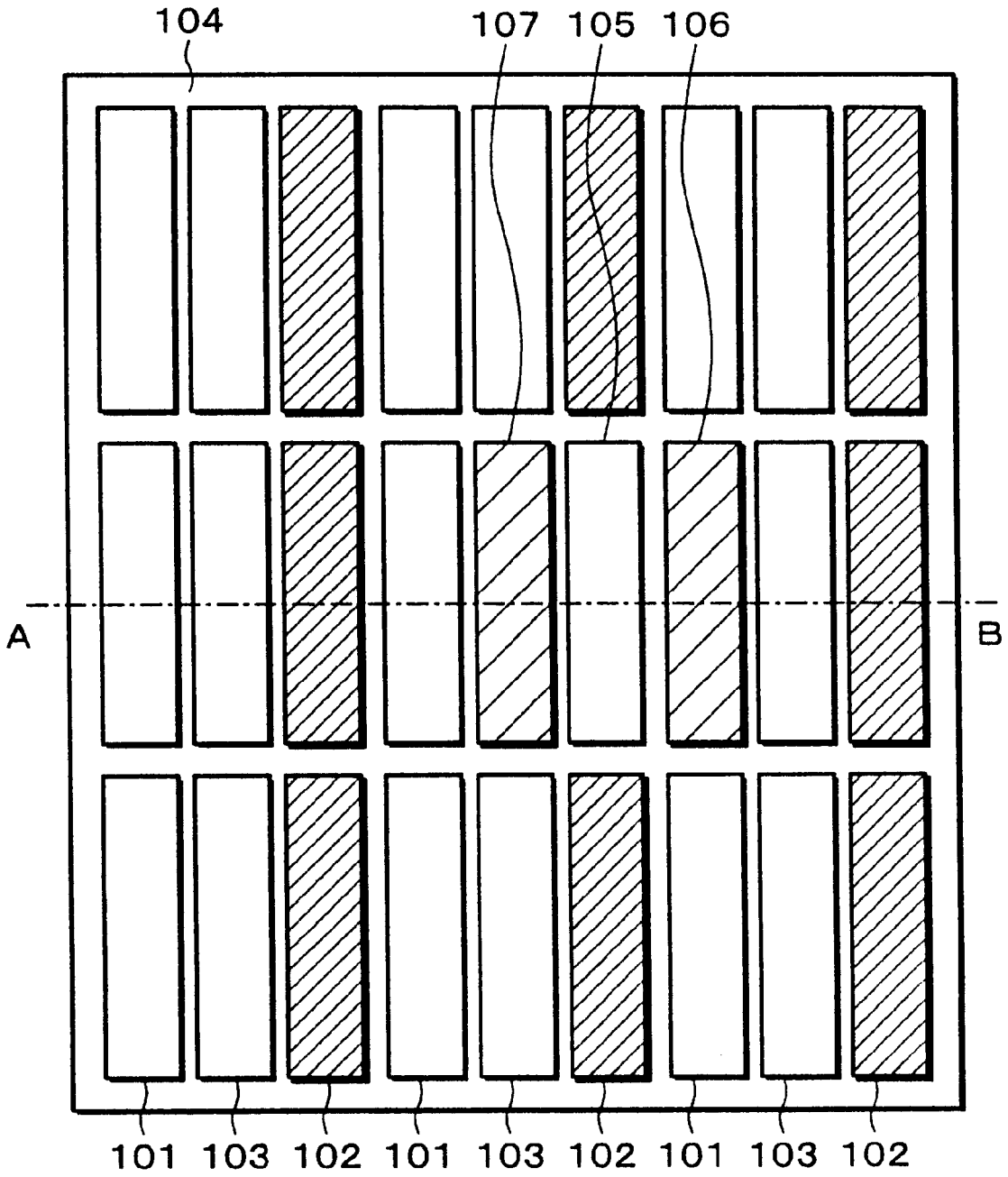
FIG. 1 is an explanatory drawing showing control exercised on a signal which is applied to two dots adjacent to a defective dot in a display panel, according to one embodiment of the present invention.
Figure 7:
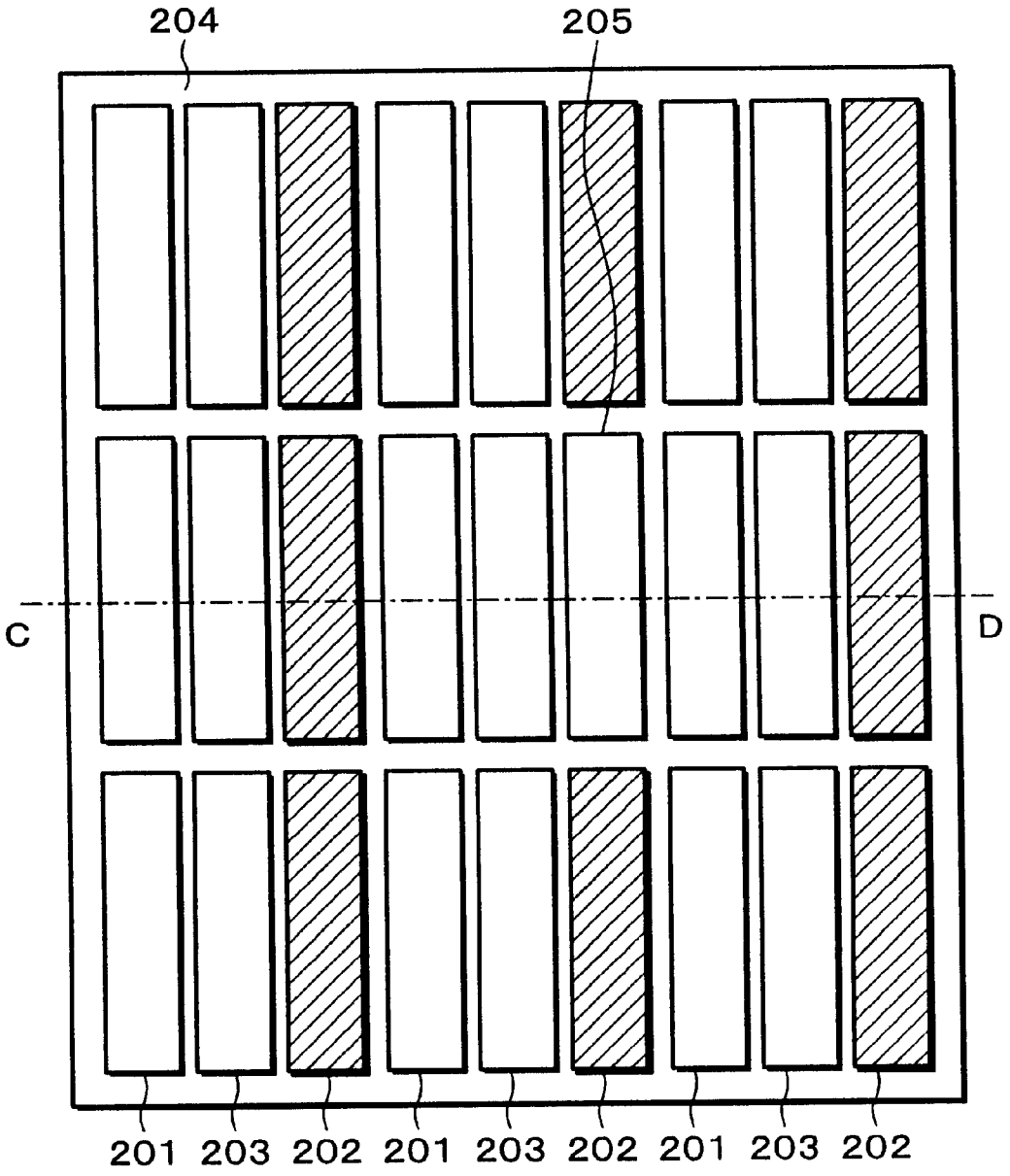
FIG. 7 is an explanatory drawing showing a conventional defect.

Referring to FIG. 1, the following explanation discusses the present embodiment. FIG. 1 corresponding to FIG. 7 is an explanatory drawing showing a part surrounding a defective dot.

In FIG. 1, dots 101 represent red, dots 102 represent blue, dots 103 represent green, 104 represents a black matrix, and the colors are aligned in longitudinal stripes. In FIG. 1, hatched parts are illuminated. Namely, FIG. 1 shows an enlarged part of the surface entirely illuminated in blue on the display device. The following explanation is provided on the assumption that only the blue dots 102 are entirely illuminated.

Here, a dot is a minimum unit of a color such as RGB, a pixel is a minimum display unit of image including each dot of RGB, etc. A single pixel is capable of displaying color and brightness.

Assuming that a blue dot 105 is defective and is turned into a black spot, although the surface needs to be entirely illuminated in blue, the defective dot cannot be illuminated. Therefore, irregular colors appear on this part, resulting in deterioration in picture quality.

In the present embodiment, a red dot 106 and a green dot 107, which are adjacent to the defective blue dot 105, are suitably illuminated. Namely, when the blue dot 105 is turned into a black spot due to an inevitable defect, regarding the red dot 106 and the green dot 107 which are adjacent to the defective dot, the illumination is controlled so as to generate around the defective blue dot 105 virtually the same brightness as a blue dot having no defect. Thus, visual deterioration can be reduced. In FIG. 1, the roughly hatched pattern shows that the red dot 106 and the green dot 107 are slightly illuminated.

Figure 2:
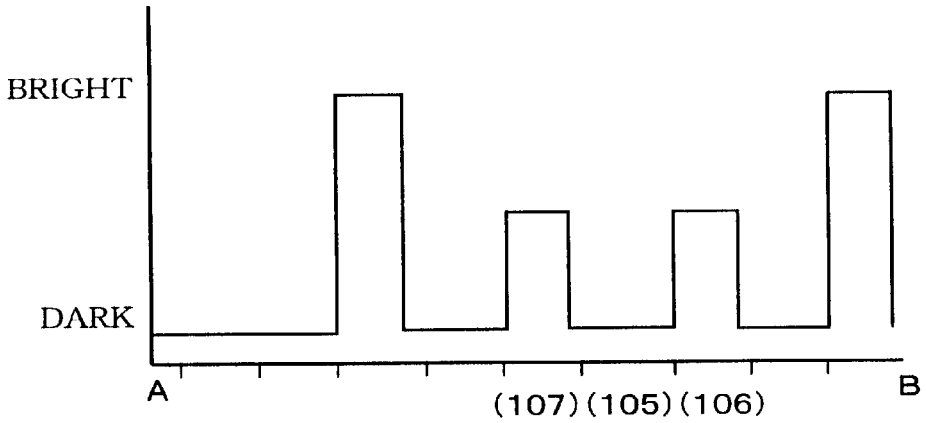
FIG. 2 is an explanatory drawing showing luminance taken along line A–B of FIG. 1.
Figure 8:
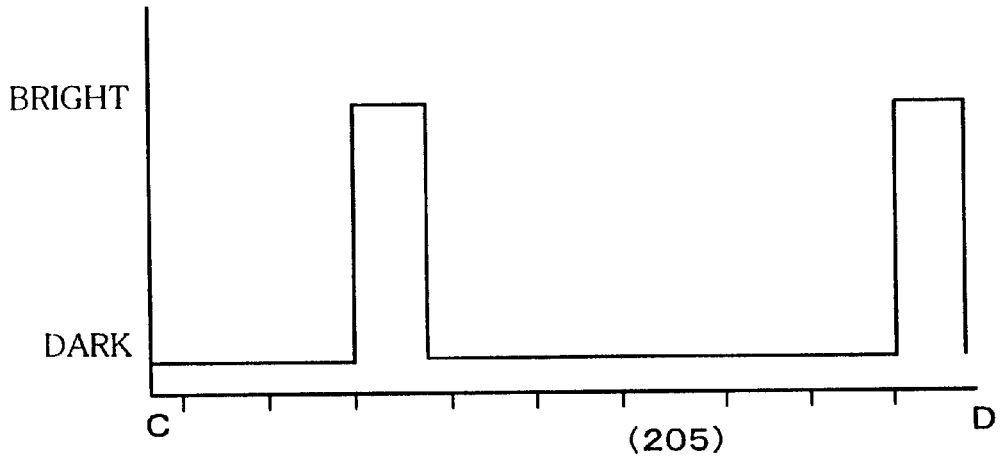
FIG. 8 is an explanatory drawing showing luminance of a sectional view taken along line C–D shown in FIG. 7.

FIG. 8 shows brightness of a sectional view taken along line C–D shown in FIG. 7. Although a blue dot 205 needs to be illuminated, it cannot be illuminated due to a defect. FIG. 2 shows brightness of a sectional view taken along line A–B shown in FIG. 1. The blue dot 105 cannot be illuminated due to a defect; however, the illumination is controlled regarding the red dot 106 and the green dot 107 which are adjacent to the defective blue dot 105, so that the defective dot 105 can obtain virtually the same blue color as required. In FIG. 2, a vertical axis represents brightness. The illumination of the adjacent red dot 106 and green dot 107 is set half of the defective blue dot 105 assuming that simple addition is available for computing brightness.

Figure 3:
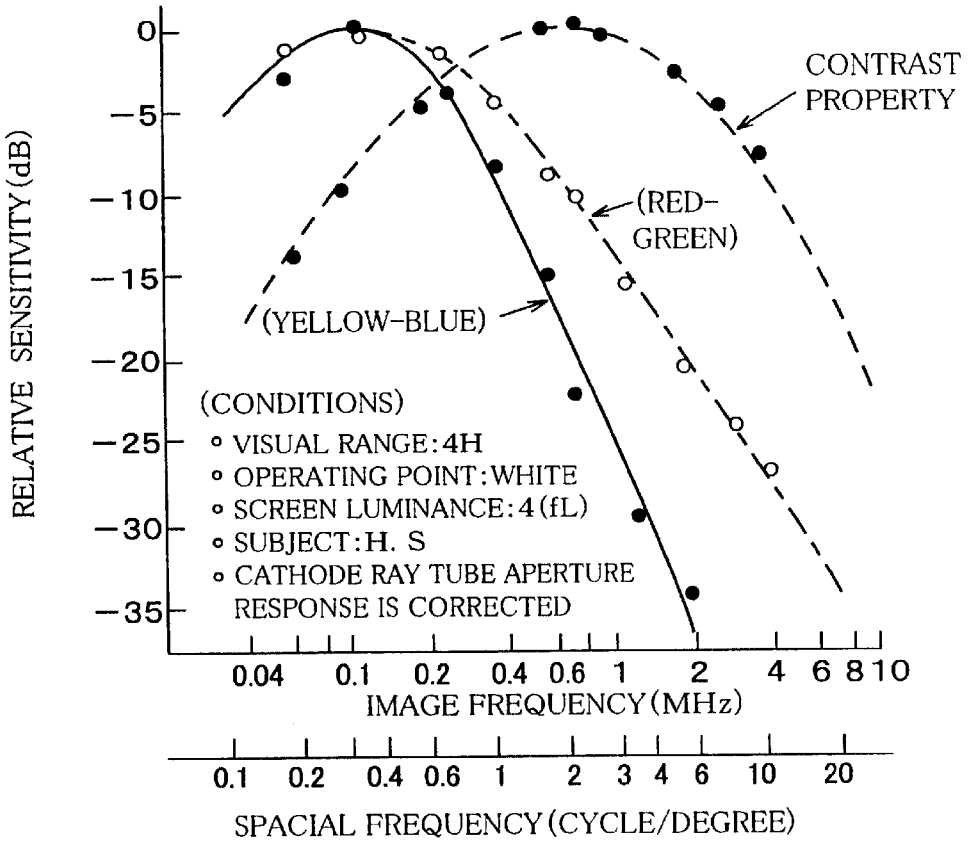
FIG. 3 is a graph showing a spacial frequency property in vision.

Incidentally, FIG. 3 shows a spacial frequency property in vision. This example is discussed in "Sakata and Isono, 'Spacial frequency property of chromaticity in vision', The Journal of the Institute of Television Engineers of Japan, Vol. 31, No.1, pp. 29–35, 1976". A horizontal axis represents a spacial frequency, i.e., a degree of a fine image, and a vertical axis represents relative response. Furthermore, parameters of three curved lines of the graph represent conditions of measured colors.

FIG. 3 shows that the visual response of contrast is about three to five times larger in band than those of red-green and yellow-blue.

Measurement examples other than Sakata et al. are available regarding a spacial frequency response in vision. Generally, the response of contrast is about several times larger in band than that of a color. Namely, a change in fine colors is generally less noticeable than a change in fine contrast.

Figure 4:
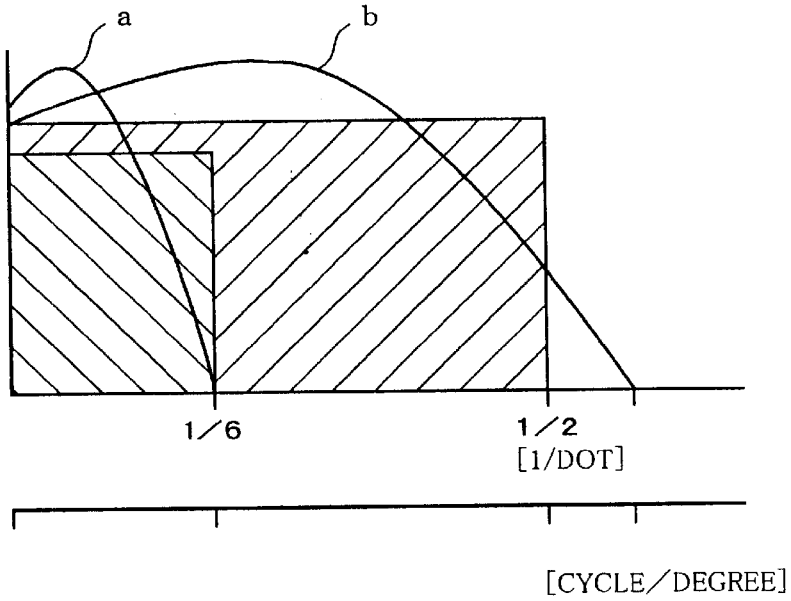
FIG. 4 is an explanatory drawing showing a relationship between the spacial frequency property in vision of FIG. 3 and control shown in FIG. 2 of the present embodiment.

FIG. 4 shows a relationship between a) a spacial frequency property in vision of FIG. 3 and b) the method of the present embodiment shown in FIG. 2. FIG. 4 shows a maximum spacial frequency that one of n dots (here, n indicates an integer of 1 or more) can display. For instance, around the defective dot 205 of FIG. 8, only one out of 6 dots is illuminated. Hence, it is only possible to provide fine display with a maximum spacial frequency of only ⅙ [1/dot]. In contrast, around the red dot 106 and the green 107 of FIG. 2, one out of two dots is illuminated so as to achieve a fine display with a maximum spacial frequency of ½ [1/dot]. In FIG. 4, these areas are each indicated by hatching.

Further, FIG. 4 also shows a plot of an example regarding a spacial frequency property shown in FIG. 3. 'a' curve is made by combining a red-green curve and a yellow-blue curve, and 'b' is a curve showing a contrast property. A unit on the horizontal axis differs between [1/dot] and [cycle/degree], so that these curves are compared in a relative manner.

As shown in FIG. 4, a degree of fine display, which is made by a spacial frequency around the defective dot of FIG. 8, virtually conforms to a color spacial frequency property in vision; meanwhile, a degree of fine display, which is made by a spacial frequency around the red dot 106 and the green dot 107 of FIG. 2, conforms to a contrast spacial frequency property in vision.

Hence, a degree of fine display, which is made by a spacial frequency of dots illuminated around the defective dot of FIG. 8, virtually conforms to a color spacial frequency property in vision but is considerably inferior to a contrast spacial frequency property in vision. In other words, even in the event of a defective dot, colors can be finely displayed in vision; meanwhile, a contrast of the defective dot cannot be sufficiently displayed. Thus, it is found that displaying ability is insufficient regarding contrast. Consequently, deterioration in picture quality of a defective dot is mainly resulted from its contrast.

Further, a degree of fine display, which is made by a spacial frequency around the red dot 106 and the green dot 107 of FIG. 2, conforms to a contrast spacial frequency property in vision but largely exceeds a color spacial frequency property in vision. In other words, regarding a fine display made by a spacial frequency around the red dot 106 and the green dot 107, only brightness is recognized but the colors are hard to recognize.

Thus, the present embodiment can make a defective dot unnoticeable using the foregoing visual properties. For instance, the deterioration in picture quality due to a defective dot is mainly resulted from its contrast. Hence, when a part around the defective dot is displayed while only brightness is recognized but the color is hard to recognize, the defective dot becomes unnoticeable. In FIG. 1, this arrangement is realized by illuminating the red dot 106 and the green dot 107 around the defective blue dot 105.

The following explanation describes a circuit construction of the present embodiment.

Figure 5:
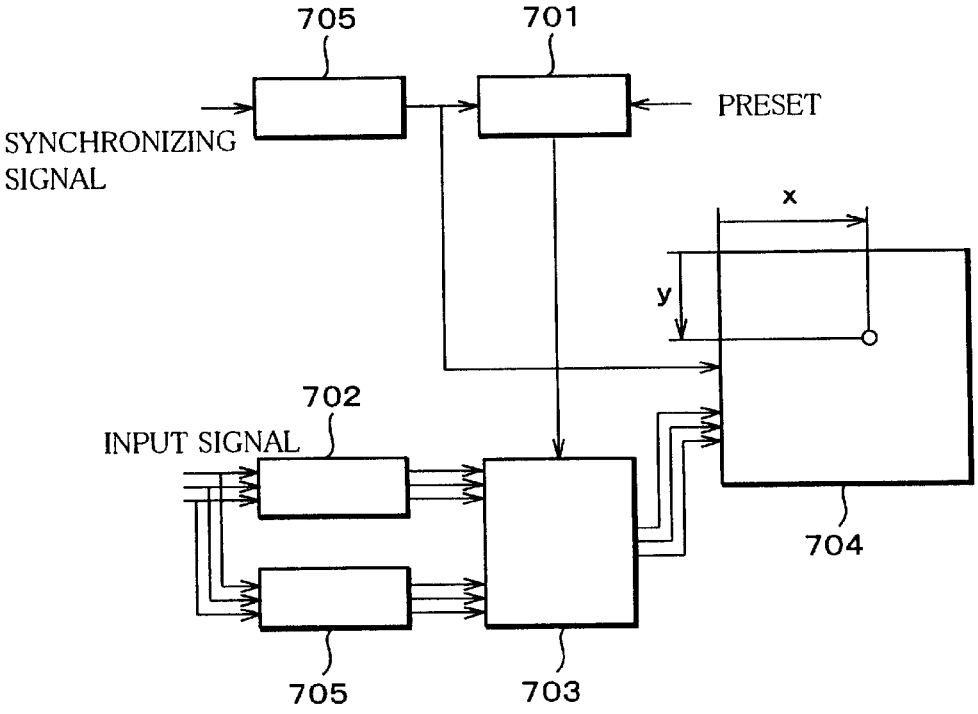
FIG. 5 is a block diagram showing the circuit construction of the above embodiment.

FIG. 5 is a block diagram showing the circuit construction of the present embodiment. FIG. 5 shows an address detecting circuit 701, an operation circuit (control means) 702, a switching circuit 703, a display panel 704, and a delay circuit 705.

On the display panel 704, a defective dot is found at an address (x, y).

The address detecting circuit 701 identifies a current display position based on a synchronizing signal and outputs a flag signal (switching signal) to the switching circuit 703 at a timing of displaying the position (x, y) of the defective dot. To be specific, such a circuit can be composed of a simple counter.

Additionally, in order to make the address detecting circuit 701 perform this operation, in the address detecting circuit 701, the counter is preset so as to output a flag signal at the address of the detected defective dot. Here, the detection of a defective dot address is not discussed in detail. To put it simply, all lighting tests are conducted to identify a defective dot, and then, the address is set.

An input signal (second signal) passing through the delay circuit 705 and an output (first signal) of the operation circuit 702 are inputted to the switching circuit 703. The output of the operation circuit 702 is outputted at a timing of a flag signal, and the input signal passing through the delay circuit 705 is directly outputted at other timings.

In the present embodiment, the operation circuit 702 multiplies a defective dot signal by a predetermined value and delivers it as a surrounding dot signal, so that the brightness of the adjacent red dot 106 and green dot 107 is set at half of the defective blue dot 105. In this case, this arrangement can be readily achieved with a suitable multiplying circuit.

Figure 6:
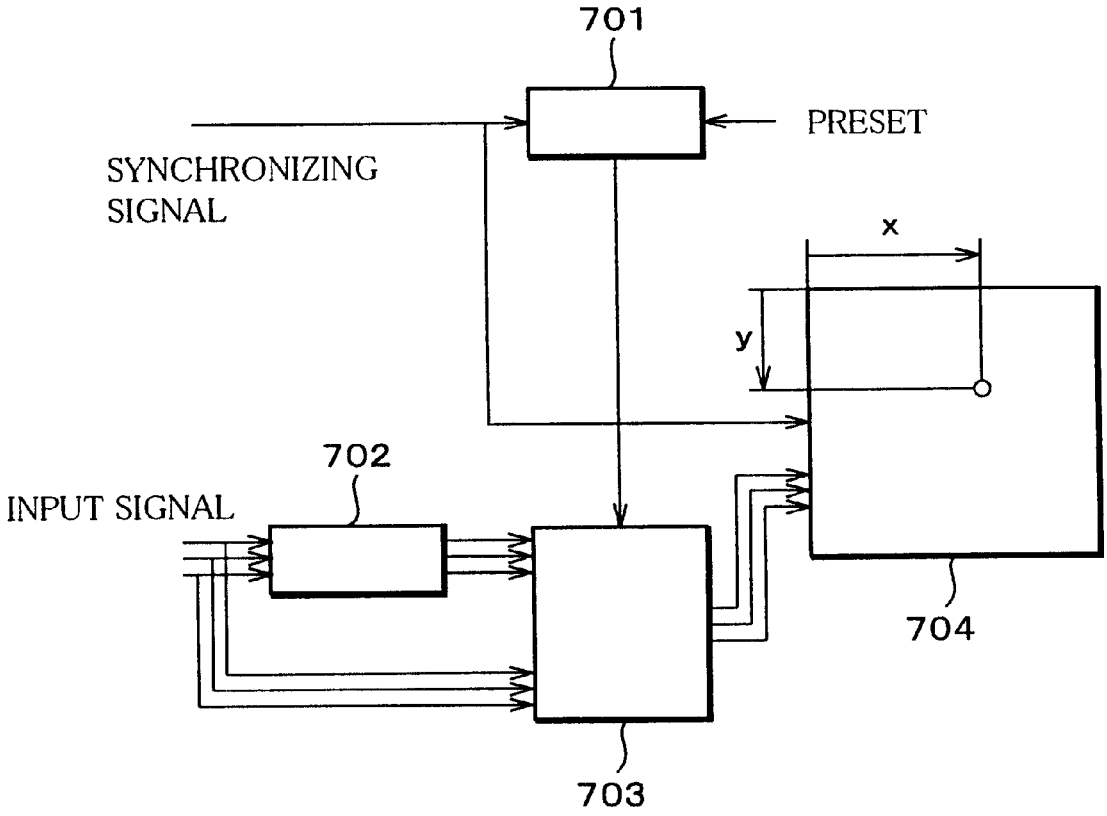
FIG. 6 is a block diagram showing another circuit construction of the above embodiment.

Further, in order to adjust delay in operation of the operation circuit 702, the delay circuit 705 applies a suitable delay to an input signal and a synchronizing signal. When the delay of the operation circuit 702 is negligible, the adjustment may be unnecessary. In this case, the entire construction is arranged as shown in FIG. 6.

The present invention is applicable to a device such as a liquid crystal display device. Additionally, the present invention can be also adopted for other display devices such as a plasma display panel (PDP) and an electroluminescence display device (EL) as long as the display device has a pixel structure and a data signal is processed in digital. Moreover, the present invention is not limited to a display device for providing a color display with a single display panel but is also adopted for a projection display system (such as a liquid crystal projector) and the like, which is provided with a plurality of panels corresponding to colors and provides a color display by synthesizing light transmitted from the panels.

Further, the present invention includes the display panel having RGB longitudinal stripe alignment. However, the present invention is not limited to this arrangement but is also applicable to a display panel having alignment such as delta alignment and mosaic alignment.

Furthermore, the present embodiment controls a signal applied to two dots adjacent to a defective dot. However, the present invention is not limited to this arrangement. Control may be exercised on a signal applied to two dots which are close to but not adjacent to a defective dot. Moreover, control may be exercised on a signal applied to a single dot, not two dots, in the vicinity of a defective dot. Furthermore, a signal applied to three or more dots may be controlled.

EMBODIMENT 2

The following description discusses the detail of the explanation referring to FIG. 2. In FIG. 2, a vertical axis represents brightness, and assuming that simple addition is available for computing brightness, brightness of a red dot 106 and a green dot 107, which are adjacent to a defective dot 105, is set at half of the defective dot 105. The illumination is arranged as follows in the present embodiment.

As described above, only brightness is recognized around a defective dot. Thus, the objective is to adjust the brightness of surrounding dots such that the defective dot virtually restores its original brightness.

The brightness is represented in a luminance unit by:

$$Y=0.3R+0.59G+0.11B$$

Here, R, G, and B represent signal values of primary colors of red, green, and blue, and γ is set at 1. Further, the chromaticity of primary colors of R, G, and B and the reference chromaticity of white conform to NTSC television standard.

Here, γ represents a value of a power when a function of a power represents a relationship of a display property between a) an input signal transmitted to the display device and b) an output of the display device. The value differs between display devices or display signals.

When primary-color chromaticity and white reference chromaticity are different from the television standard, coefficients such as 0.3 and 0.59 are also different. The coefficient values can be readily computed according to a color theory. The detail is not discussed here.

According to the above equation, for example, in order to allow the defective blue dot 105 to have the same brightness as the red dot 106 and the green dot 107 by illuminating the above dots, R and G may be set to satisfy:

$$0.11B=0.3R+0.59G$$

As shown in FIG. 2, when the red and green dots are illuminated with half brightness of the blue dot, $$0.11B<(0.3+0.59)\times 0.5B=0.445B$$

is obtained, which means the surrounding dots cannot be illuminated with the same brightness as the defective dot. The objective of the present embodiment is to solve the above problem. Hereinafter, it is assumed that the two dots around the defective dot are not originally illuminated, equal signal values are applied thereto.

For instance, when the blue dot is defective and the other two dots are not originally illuminated, a K value is set so as to satisfy the following equation:

$$0.11B=(0.3+0.59)\times KB$$

According to this equation, assuming that the blue dot is defective and the other red and green dots are not illuminated, the brightness around the defective dot is determined only by 0.11B of the left side, and assuming that equal signal values are applied to the surrounding red and green dots, $$R=G=KB$$

is set so as to compute, regarding a signal value applied to the red and green dots, what degree of value should be in response to a signal value of the defective blue dot.

According to this equation, $$K=0.1236$$

is found. Thus, it is understood that a signal value of the blue dot should be multiplied by 0.1236 and the resulting value is added to the adjacent red and green dots before illumination.

In the same manner, when a red dot is defective, according to:

$$0.3R=(0.11+0.59)\times KR,$$

$$K=0.4286$$

is found. Thus, it is understood that a signal value of the red dot should be multiplied by 0.4386 and the resulting value is added to the adjacent green and blue dots before illumination.

Furthermore, when a green dot is defective, according to:

$$0.59G=(0.11+0.3)\times KG,$$

$$K=1.439$$

is found. Thus, it is understood that a signal value of the green dot should be multiplied by 1.439 and the resulting value is added to the adjacent red and blue dots before illumination.

Additionally, the above explanation is made on the assumption of γ=1. Considering an actual display of γ (γ>1 in many cases), the above coefficient value K is also changed.

In the case of $\gamma=2$, $$Y=(0.3R^2+0.59G^2+0.11B^2)^{0.5}$$

is established. Hence, when a blue dot is defective, $$0.11B^2=(0.3+0.59)\times(KB)^2$$

is established, and $$K=0.3516$$

is found. In other words, a signal value of the blue dot is multiplied by 0.3516 and the resulting value is added to the adjacent red and green dots, so that the defect becomes more unnoticeable. When red and green dots are defective, the process is the same.

The following is omitted in the foregoing explanation: Further, when primary-color chromaticity and white reference chromaticity are different from television standard, the coefficients such as 0.3 and 0.59 are different, so that the coefficient value K obtained in the foregoing explanation is also changed accordingly. The coefficient K value can be computed in the same manner without any problems as long as the coefficients such as 0.3 and 0.59 are computed according to the color theory.

Moreover, it is also possible to freely set the K value depending on a characteristic of a defect so as to make the defect most unnoticeable in vision.

Also, in the present embodiment, equal signal values are applied to two dots adjacent to a defective dot; however, different signal values may be applied to the adjacent two dots.

The circuit construction of the present embodiment can be realized by the same construction of Embodiment 1 shown in FIGS. 5 and 6. In this case, an operation circuit 702 multiplies a defective dot signal by the K value, and delivers the resulting signal to the two dots adjacent to the defective dot.

EMBODIMENT 3

Figure 9:
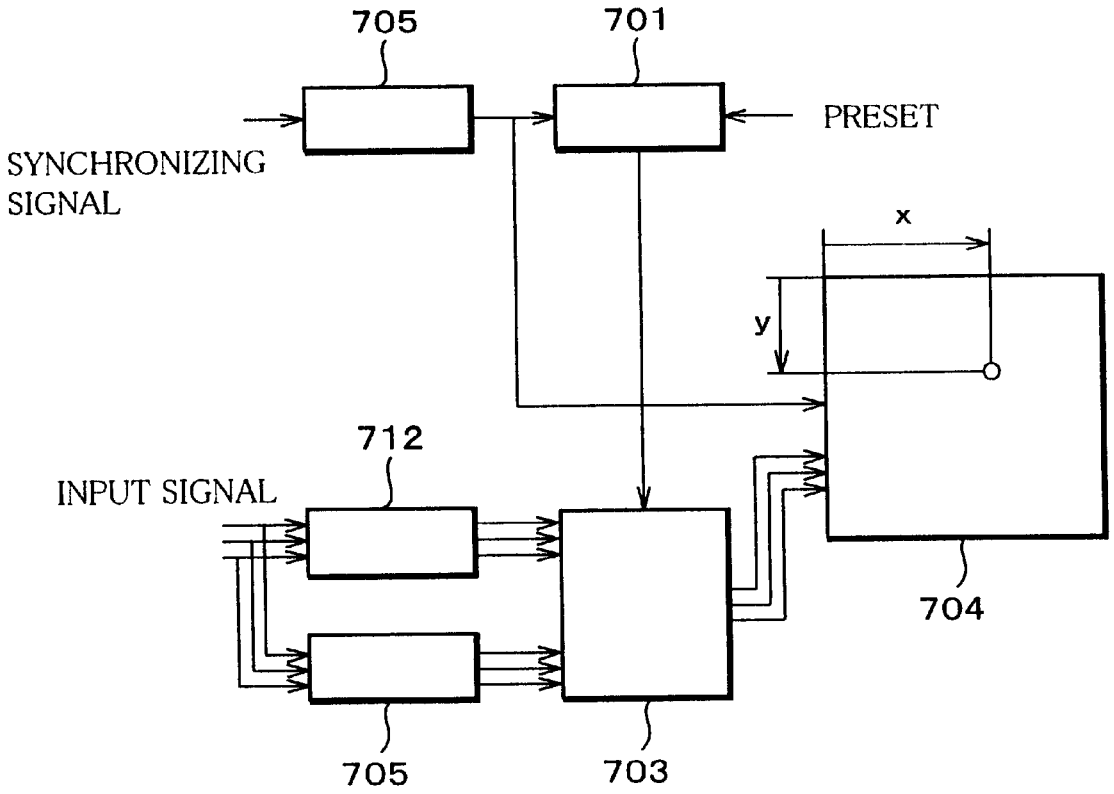
FIG. 9 is a block diagram showing the circuit construction according to another embodiment of the present invention.

Referring to FIG. 9, the following explanation describes another embodiment of the present invention. Here, for convenience of explanation, those members that have the same functions and that are described in the above embodiments are indicated by the same reference numerals and the description thereof is omitted.

In the present embodiment, a signal applied to n dots is controlled so as to reduce a difference between a) a color obtained by illumination of the n dots around a defective dot and b) an original color obtained by an input signal of the defective dot and the n dots (preferably to a minimum).

As shown in FIG. 9, the circuit construction of the present embodiment is identical to those of Embodiments 1 and 2. However, upon operating a signal value applied to the n dots, the operation circuit 712 is different from an operation circuit 702 in the following operation.

Besides, in the present embodiment, the n dots represent two dots, and control is exercised on a signal applied to the two dots adjacent to a defective dot. Here, CIE (1976) L*a*b*color difference is used to show color difference, and CIE (1976) L*a*b*color value is used to show a color value.

The CIE (1976) L*a*b*color value is discussed in publications such as Japanese Laid-Open Patent Publication 329495/1997 (Tokukaihei 9-329495) and has been widely known. The value is defined as follows.

Namely, when the defective dot and the two dots respectively have input signals of Ri, Gi, and Bi, three stimulus values Xi, Yi, and Zi under an 8-bit (256 levels of gray) condition are represented by:

$$\left.\begin{aligned} X_i &= 100\left\{X_R\left(\frac{R_i}{255}\right)^{\gamma R}+X_G\left(\frac{G_i}{255}\right)^{\gamma G}+X_B\left(\frac{B_i}{255}\right)^{\gamma B}\right\}\\ Y_i &= 100\left\{Y_R\left(\frac{R_i}{255}\right)^{\gamma R}+Y_G\left(\frac{G_i}{255}\right)^{\gamma G}+Y_B\left(\frac{B_i}{255}\right)^{\gamma B}\right\}\\ Z_i &= 100\left\{Z_R\left(\frac{R_i}{255}\right)^{\gamma R}+Z_G\left(\frac{G_i}{255}\right)^{\gamma G}+Z_B\left(\frac{B_i}{255}\right)^{\gamma B}\right\}\end{aligned}\right\} \quad (1)$$

In this case, according to the CIE (1976) L*a*b*color value, L*, a*, b* are respectively represented by:

$$\left.\begin{aligned} &\text{luminance } L^* = 116\left(\frac{Y}{Y_n}\right)^{\frac{1}{3}}-16 \quad \left(\frac{Y}{Y_n}>0.008856\right)\\ &\text{luminance } L^* = 903.29\left(\frac{Y}{Y_n}\right) \quad \left(\frac{Y}{Y_n}\le 0.008856\right)\\ &a^* = 500\left\{\left(\frac{X}{X_n}\right)^{\frac{1}{3}}-\left(\frac{Y}{Y_n}\right)^{\frac{1}{3}}\right\}\\ &b^* = 200\left\{\left(\frac{Y}{Y_n}\right)^{\frac{1}{3}}-\left(\frac{Z}{Z_n}\right)^{\frac{1}{3}}\right\}\end{aligned}\right\} \quad (2)$$

Further, according to the CIE (1976) L*a*b*color difference, $\Delta E^*$ is represented by:

$$\Delta E^* = \sqrt{(L_1^*-L_2^*)^2+(a_1^*-a_2^*)^2+(b_1^*-b_2^*)^2}$$

Here, on the assumption that a red dot R is defective, conditions for controlling $G_2$ and $B_2$ of output signals ($R_2$, $G_2$, $B_2$) relative to input signals ($R_1$, $G_1$, $B_1$) to minimize a color difference. Here, a color difference is minimized on the assumption that two dots adjacent to the defective dot are not originally illuminated at all, and that the sum of luminance of the two dots is virtually the same as original luminance obtained based on an input signal of the defective dot; namely, under the condition of $\Delta L^*=0$.

In this case, $\Delta E$ is represented by:

$$\begin{aligned}\Delta E^* &= \sqrt{(L_1^*-L_2^*)^2+(a_1^*-a_2^*)^2+(b_1^*-b_2^*)^2}\\ &= \sqrt{(a_1^*-a_2^*)^2+(b_1^*-b_2^*)^2}\\ &= \left(500^2\left[\left\{\left(\frac{X_1}{X_n}\right)^{\frac{1}{3}}-\left(\frac{Y_1}{Y_n}\right)^{\frac{1}{3}}\right\}-\left\{\left(\frac{X_2}{X_n}\right)^{\frac{1}{3}}-\left(\frac{Y_2}{Y_n}\right)^{\frac{1}{3}}\right\}\right]^2+\right.\\ &\qquad \left.200^2\left[\left\{\left(\frac{Y_1}{Y_n}\right)^{\frac{1}{3}}-\left(\frac{Z_1}{Z_n}\right)^{\frac{1}{3}}\right\}-\left\{\left(\frac{Y_2}{Y_n}\right)^{\frac{1}{3}}-\left(\frac{Z_2}{Z_n}\right)^{\frac{1}{3}}\right\}\right]^2\right)^{\frac{1}{2}}\\ &= \left(500^2\left[\left\{\left(\frac{X_1}{X_n}\right)^{\frac{1}{3}}-\left(\frac{X_2}{X_n}\right)^{\frac{1}{3}}\right\}-\left\{\left(\frac{Y_1}{Y_n}\right)^{\frac{1}{3}}-\left(\frac{Y_2}{Y_n}\right)^{\frac{1}{3}}\right\}\right]^2+\right.\\ &\qquad \left.200^2\left[\left\{\left(\frac{Y_1}{Y_n}\right)^{\frac{1}{3}}-\left(\frac{Y_2}{Y_n}\right)^{\frac{1}{3}}\right\}-\left\{\left(\frac{Z_1}{Z_n}\right)^{\frac{1}{3}}-\left(\frac{Z_2}{Z_n}\right)^{\frac{1}{3}}\right\}\right]^2\right)^{\frac{1}{2}}\end{aligned}$$

Here, according to $\Delta L^*=0$, $Y_1=Y_2$ is found. Hence, the following relationship is established:

$$\Delta E^* = \left[500^2\left\{\left(\frac{X_1}{X_n}\right)^{\frac{1}{3}} - \left(\frac{X_2}{X_n}\right)^{\frac{1}{3}}\right\}^2 + 200^2\left\{\left(\frac{Z_1}{Z_n}\right)^{\frac{1}{3}} - \left(\frac{Z_2}{Z_n}\right)^{\frac{1}{3}}\right\}^2\right]^{\frac{1}{2}}$$

Further, according to the foregoing equation (1), $R_2=0$ is found according to R defect.

$$\Delta E^* = \left(500^2\left\{\left[\frac{100}{X_n}\left\{X_R\left(\frac{R_1}{255}\right)^{\gamma R} + X_G\left(\frac{G_1}{255}\right)^{\gamma G} + X_B\left(\frac{B_1}{255}\right)^{\gamma B}\right\}\right]^{\frac{1}{3}} - \left(\left[\frac{100}{X_n}\left(X_G\left(\frac{G_2}{255}\right)^{\gamma G} + X_B\left(\frac{B_2}{255}\right)^{\gamma B}\right\}\right]\right)^{\frac{1}{3}}\right\}^2 + 200^2\left\{\left[\frac{100}{Z_n}\left\{Z_R\left(\frac{R_1}{255}\right)^{\gamma R} + Z_G\left(\frac{G_1}{255}\right)^{\gamma G} + Z_B\left(\frac{B_1}{255}\right)^{\gamma B}\right\}\right]^{\frac{1}{3}} - \left(\left[\frac{100}{Z_n}\left\{Z_G\left(\frac{G_2}{255}\right)^{\gamma G} + Z_B\left(\frac{B_2}{255}\right)^{\gamma B}\right\}\right]^{\frac{1}{3}}\right\}^2\right)^{\frac{1}{2}}$$

Besides, according to $\Delta L^*=0 \Leftrightarrow L_1^*=L_2^* \Leftrightarrow Y_1=Y_2$ and $R_2=0$, the following relationship is established:

$$Y_R\left(\frac{R_1}{255}\right)^{\gamma R} + Y_G\left(\frac{G_1}{255}\right)^{\gamma G} + Y_B\left(\frac{B_1}{255}\right)^{\gamma B} = Y_G\left(\frac{G_2}{255}\right)^{\gamma G} + Y_B\left(\frac{B_2}{255}\right)^{\gamma B} \Rightarrow \left(\frac{B_2}{255}\right)^{\gamma B} = \frac{1}{Y_B}\left\{Y_R\left(\frac{R_1}{255}\right)^{\gamma R} + Y_G\left(\frac{G_1}{255}\right)^{\gamma G} + Y_B\left(\frac{B_1}{255}\right)^{\gamma B} - Y_G\left(\frac{G_2}{255}\right)^{\gamma G}\right\} \quad (3)$$

Hence, the following relationship is further established:

$$\Delta E^* = \left[500^2\left\{\left[\frac{100}{X_n}\left\{X_R\left(\frac{R_1}{255}\right)^{\gamma R} + X_G\left(\frac{G_1}{255}\right)^{\gamma G} + X_B\left(\frac{B_1}{255}\right)^{\gamma B}\right\}\right]^{\frac{1}{3}} - \left(\frac{100}{X_n}\left[X_G\left(\frac{G_2}{255}\right)^{\gamma G} + \frac{X_B}{Y_B}\left\{Y_R\left(\frac{R_1}{255}\right)^{\gamma R} + Y_G\left(\frac{G_1}{255}\right)^{\gamma G} + Y_B\left(\frac{B_1}{255}\right)^{\gamma B} - Y_G\left(\frac{G_2}{255}\right)^{\gamma G}\right\}\right]\right)^{\frac{1}{3}}\right\}^2 + 200^2\left\{\left[\frac{100}{Z_n}\left\{Z_R\left(\frac{R_1}{255}\right)^{\gamma R} + Z_G\left(\frac{G_1}{255}\right)^{\gamma G} + Z_B\left(\frac{B_1}{255}\right)^{\gamma B}\right\}\right]^{\frac{1}{3}} - \left(\frac{100}{Z_n}\left[Z_G\left(\frac{G_2}{255}\right)^{\gamma G} + \frac{Z_B}{Y_B}\left\{Y_R\left(\frac{R_1}{255}\right)^{\gamma R} + Y_G\left(\frac{G_1}{255}\right)^{\gamma G} + Y_B\left(\frac{B_1}{255}\right)^{\gamma B} - Y_G\left(\frac{G_2}{255}\right)^{\gamma G}\right\}\right]\right)^{\frac{1}{3}}\right\}^2\right]^{\frac{1}{2}}$$

$$= \left[500^2\left\{\left[\frac{100}{X_n}\left\{X_R\left(\frac{R_1}{255}\right)^{\gamma R} + X_G\left(\frac{G_1}{255}\right)^{\gamma G} + X_B\left(\frac{B_1}{255}\right)^{\gamma B}\right\}\right]^{\frac{1}{3}} - \left(\frac{100}{X_n}\left[\frac{X_B}{Y_B}\left\{Y_R\left(\frac{R_1}{255}\right)^{\gamma R} + Y_G\left(\frac{G_1}{255}\right)^{\gamma G} + Y_B\left(\frac{B_1}{255}\right)^{\gamma B}\right\} + \left(X_G - \frac{X_B}{Y_B}Y_G\right)\left(\frac{G_2}{255}\right)^{\gamma G}\right]\right)^{\frac{1}{3}}\right\}^2 + 200^2\left\{\left[\frac{100}{Z_n}\left\{Z_R\left(\frac{R_1}{255}\right)^{\gamma R} + Z_G\left(\frac{G_1}{255}\right)^{\gamma G} + Z_B\left(\frac{B_1}{255}\right)^{\gamma B}\right\}\right]^{\frac{1}{3}} - \left(\frac{100}{Z_n}\left[\frac{Z_B}{Y_B}\left\{Y_R\left(\frac{R_1}{255}\right)^{\gamma R} + Y_G\left(\frac{G_1}{255}\right)^{\gamma G} + Y_B\left(\frac{B_1}{255}\right)^{\gamma B}\right\} + \left(Z_G - \frac{Z_B}{Y_B}Y_G\right)\left(\frac{G_2}{255}\right)^{\gamma G}\right]\right)^{\frac{1}{3}}\right\}^2\right]^{\frac{1}{2}}$$

Consequently, a color difference can be minimized as follows: a value of a signal $G_2$ inputted to a green dot is computed such that a value of the right side of the above equation is smaller with respect to the input signals ($R_1$, $G_1$, $B_1$), preferably such that a value of the right side is minimized.

Further, a value of a signal $B_2$ to a blue dot can be computed as follows.

According to the foregoing equation (3), the following relationship is established:

$$B_2 = 255\left\{\frac{Y_R\left(\frac{R_1}{255}\right)^{\gamma R} + Y_G\left(\frac{G_1}{255}\right)^{\gamma G} + Y_B\left(\frac{B_1}{255}\right)^{\gamma B} - Y_G\left(\frac{G_2}{255}\right)^{\gamma G}}{Y_B}\right\}^{\frac{1}{\gamma B}}$$

The $G_2$ and $B_2$ are obtained in this way and serve as signals applied to two dots adjacent to a defective dot. Further, as mentioned above, the foregoing operation is performed by an operation circuit 712. To be specific, hardware such as a CPU and a DSP is applicable. With this arrangement, it is possible to create virtually the same state as an original color (chroma) of the defective red dot R; hence, it is possible to suppress a display defect caused by a defective dot.

Here, a red dot is defective in the above example; however, in the case of blue and green defective dots as well, a signal to two dots, which are adjacent to a defective dot, can be computed based on an input signal.

Moreover, in the present embodiment, an operation is carried out based on CIE (1976) L*a*b*color value; however, the present invention is not limited to this value. The operation can be performed based on values such as CIE (1976) L*u*v*color value and CIELab97s color value. Any value is basically applicable as long as it obtains a color perceptible to the human eye.

Additionally, in the present embodiment, regarding luminance difference as well as color difference, a signal applied to two dots adjacent to a defective dots is controlled such that the sum of luminance of the two dots is virtually equal to a sum of original luminance, which is computed based on an input signal applied to the defective dot and the adjacent two dots. Also, only a difference in color may be taken into consideration. In this case, a signal to the adjacent signals is controlled to reduce a difference in color.

Besides, the present embodiment has a circuit construction including a delay circuit 705 for adjusting delay in time that is caused by performing an operation in the operation circuit 712. In the case of negligible delay, the delay circuit can be omitted as shown in FIG. 6.

EMBODIMENT 4

Referring to FIGS. 10 to 13, the following explanation describes another embodiment of the present invention. Here, for convenience of explanation, those members that have the same functions and that are described in the above embodiments are indicated by the same reference numerals and the description thereof is omitted.

In the present embodiment, in addition to luminance, a signal applied to n dots is controlled such that a color obtained by illuminating n dots, which are adjacent to the defective dot, is closer to a color obtained by averaging a) an original color of a pixel including the defective dot and b) an original color of one or more pixels around the above pixel.

Figure 10:
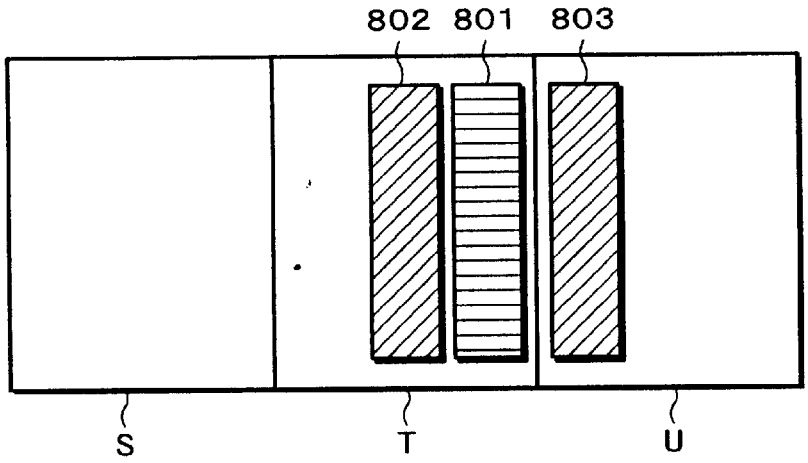
FIG. 10 is an explanatory drawing showing control exercised on a signal which is applied to a dot adjacent to a defective dot in a display panel, according to still another embodiment of the present invention.

Further, as shown in FIG. 10, the present embodiment controls a signal applied to two dots 802 and 803, which are adjacent to a defective dot 801. Here, the n dots are represented by the dots 802 and 803. An average color is obtained by averaging a) an original color of a pixel T including the defective dot 801 and b) an original color of two pixels S and U, which are adjacent to the pixel T. Furthermore, regarding colors, the CIE (1976) L*a*b*color value is used.

Figure 11:
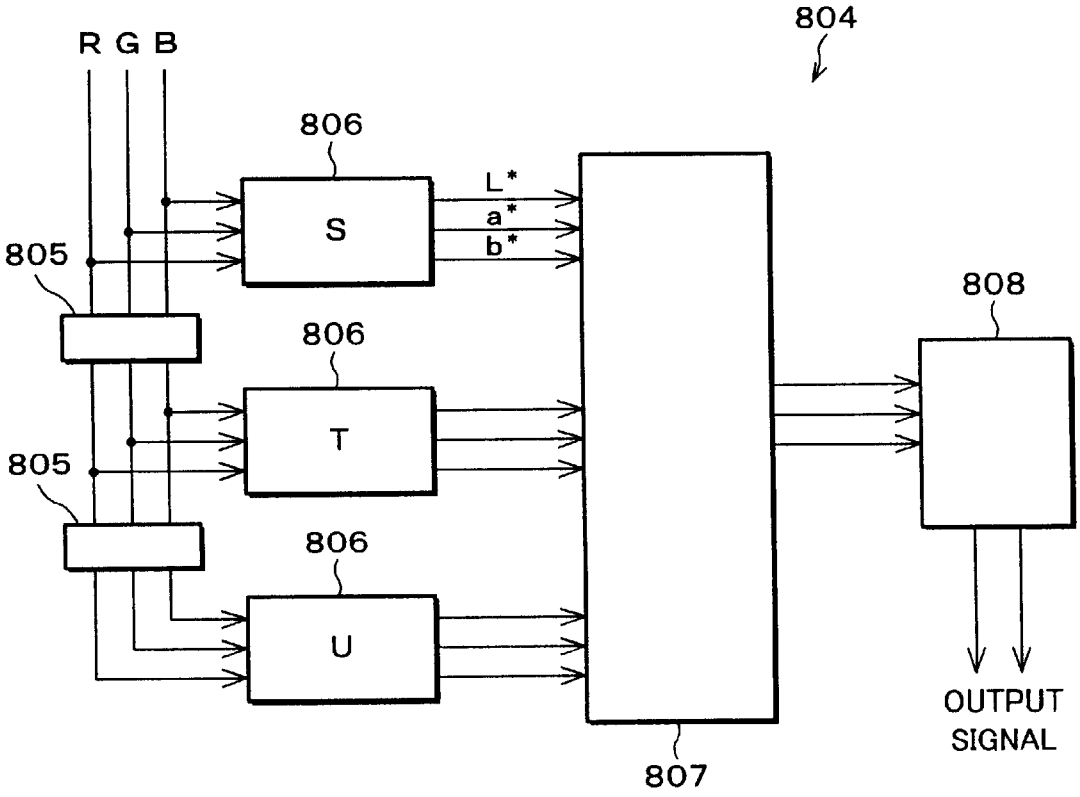
FIG. 11 is a block diagram showing the circuit construction of the above embodiment.

Moreover, the circuit construction of the present embodiment is identical to those of Embodiments 1 to 3; however, an operation circuit 804 is different from operation circuits 702 and 712 in the construction shown in FIG. 11.

Referring to FIG. 11, the operation circuit 804 of the present embodiment is provided with delay circuits 805, color computing sections 806, an averaging circuit 807, and a signal synthesization circuit (output circuit) 808. In this case, the color computing sections 806 and the averaging circuit 807 correspond to an average color value computing circuit.

The delay circuits 805 are provided for delaying input signal data by one pixel. Thus, the color computing sections 806 can simultaneously compute the adjacent pixels S, T, and U. Here, input signal data is inputted in the order of U, T, and S.

The color computing section 806 is provided for computing a CIE (1976) L*a*b*color value for each of the pixels S, T, and U. Hence, it is possible to obtain a CIE (1976) L*a*b*color value of each pixel.

Each of the obtained L*a*b*values is inputted to the averaging circuit 807, and L* (average), a* (average) and b* (average), which are averaged for three pixels, are obtained in the averaging circuit 807.

Subsequently, these values are inputted to the signal synthesization circuit 808. Here, on the assumption that a blue dot is defective, red and green dots are taken out as output signals. Even when red or green dots are defective, the process is the same.

The following computing is carried out in the signal synthesization circuit 808. Namely, when a blue dot is defective, assuming that an output of the blue dot is 0, red and green dots, which achieve a color value closest to the obtained L* (average), a* (average), and b* (average) are taken out as output values.

The following explanation discusses the detail of the operation in the operation circuit 804. Here, for example, a blue (B) dot is defective.

Original signal values of the pixels S, T, and U are represented by ($R_{S1}$, $G_{S1}$, $B_{S1}$), ($R_{T1}$, $G_{T1}$, $B_{T1}$), and ($R_{U1}$, $G_{U1}$, $B_{U1}$). Signal values actually applied to the pixels S, T, and U are represented by ($R_{S2}$, $G_{S2}$, $B_{S2}$), ($R_{T2}$, $G_{T2}$, $B_{T2}$), and ($R_{U2}$, $G_{U2}$, $B_{U2}$).

Moreover, original color values of the pixels S, T, and U are represented by ($L^*_{S1}$, $a^*_{S1}$, $b^*_{S1}$), ($L^*_{T1}$, $a^*_{T1}$, $b^*_{T1}$) and ($L^*_{U1}$, $a^*_{U1}$, $b^*_{U1}$). Color values actually applied to the S, T, and U pixels are represented by ($L^*_{S2}$, $a^*_{S2}$, $b^*_{S2}$), ($L^*_{T2}$, $a^*_{T2}$, $b^*_{T2}$), and ($L^*_{U2}$, $a^*_{U2}$, $b^*_{U2}$).

Hence, firstly, the color computing section 806 computes ($L^*_{S1}$, $a^*_{S1}$, $b^*_{S1}$), ($L^*_{T1}$, $a^*_{T1}$, b v $_{T1}$) and ($L^*_{U1}$, $a^*_{U1}$, $b^*_{U1}$), which are the original color values of S, T, and U, according to the above equations (1) and (2).

Next, the averaging circuit 807 computes an original color value ($L^*_{avg1}$, $a^*_{avg1}$, $b^*_{avg1}$) which is an average of the three pixels S, T, and U according to the following equations.

$$L^*_{avg1}=(L^*_{S1}+L^*_{T1}+L^*_{U1})/3$$

$$a^*_{avg1}=(a^*_{S1}+a^*_{T1}+a^*_{U1})/3$$

$$b^*_{avg1}=(b^*_{S1}+b^*_{T1}+b^*_{U1})/3$$

Further, in the signal synthesization circuit 808, output signals applied to the dots 802 and 803 (see FIG. 10), namely, $G_{T2}$ and $R_{U2}$ are computed as follows.

Actual color values ($L^*_{avg2}$, $a^*_{avg2}$, $b^*_{avg2}$), which are an average of the three pixels S, T, and U, are respectively represented by:

$$L^*_{avg2}=(L^*_{S2}+L^*_{T2}+L^*_{U2})/3$$

$$a^*_{avg2}=(a^*_{S2}+a^*_{T2}+a^*_{U2})/3$$

$$b^*_{avg2}=(b^*_{S2}+b^*_{T2}+b^*_{U2})/3$$

Here, since an averaged luminance is equal before and after correction (before and after control), the following relationship is established.

$$L^*_{avg1}=L^*_{avg2} \tag{4}$$

Moreover, in this case, a blue (B) dot is defective, and only output signals applied to the dots 802 and 803 require control and adjustment, so that only $G_{T2}$ and $R_{U2}$ are variables of output signal values. Thus, according to the above equation (4), the $R_{U2}$ can be represented by a function of the $G_{T2}$.

And then, a value of $G_{T2}$ is computed such that an average color value of output is the closest to an original average color value; namely, $|a^*_{avg2}-a^*_{avg1}|$ and $|b^*_{avg2}-b^*_{avg1}|$ are minimum.

After computing the $G_{T2}$, the $R_{U2}$ can be computed according to the above equation (4).

The output values $G_{T2}$ and $R_{U2}$ of green and red, that are obtained in the above manner, are applied to the two dots 802 and 803 adjacent to the defective dot 801 so as to display a color conforming to an original color on or around the pixel T, which includes the defective dot 801. Consequently, the defective dot 801 becomes largely unnoticeable.

Here, the delay circuits 805 may be provided in the color computing sections 806 or the averaging section 807.

Figure 12:
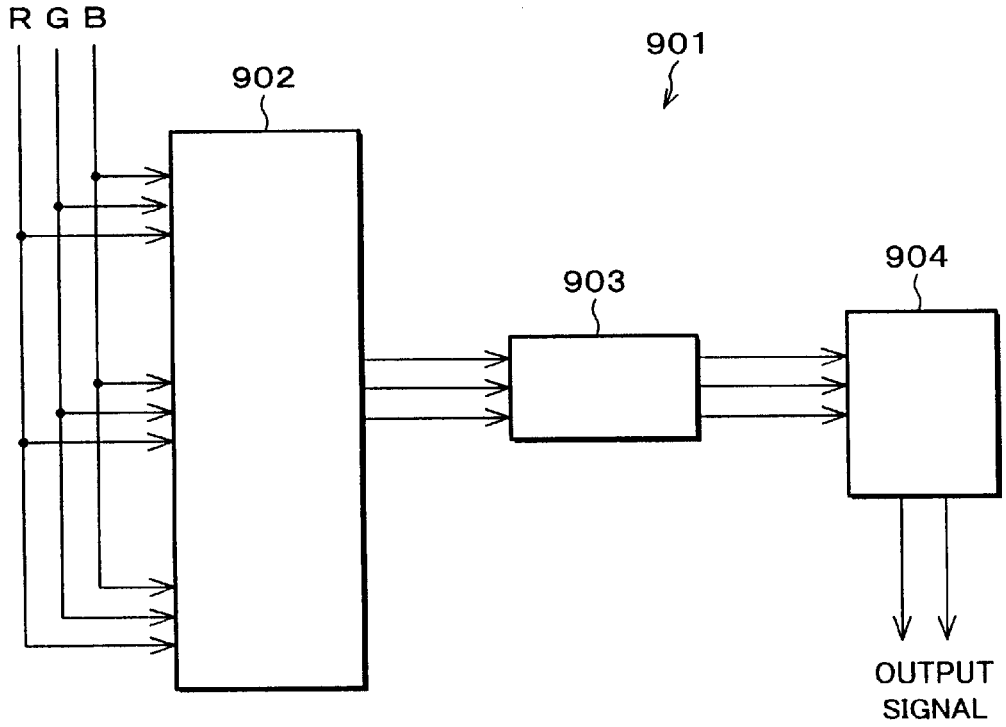
FIG. 12 is a block diagram showing another circuit construction of the above embodiment.

Also, a simpler operation circuit 901 shown in FIG. 12 may be adopted instead of the operation circuit 804 of the present embodiment. The operation circuit 901 is provided with an averaging circuit 902, a color computing section 903, and a signal synthesization circuit (output circuit) 904 (in this case, the averaging circuit 902 and the color computing section 903 correspond to an average color value computing section), and delay circuits are provided in the averaging circuit 902.

RGB is inputted to the color computing section 903. The RGB is an average of three pixels. L* (average), a* (average), and b* (average) are computed based on the RGB and are outputted from the color computing section 903. In this point, the color computing section 903 is distinct from the color computing section 806, which computes a CIE (1976) L*a*b*color value for each of the pixels S, T, and U.

In the operation circuit 901, an inputted RGB signal is first inputted to the averaging circuit 902, and an RGB average of the three pixels is obtained in the averaging circuit 902. Subsequently, an RGB average of the three pixels is inputted to the color computing section 903, and L* (average), a* (average), and b* (average) are computed therein. The process of inputting these values to the signal synthesization circuit 904 and the process thereafter are the same as the foregoing explanation.

Here, in the present embodiment, an adjacent pixel is adopted; however, an applicable pixel is not limited to an adjacent pixel. For instance, the pixel can be one pixel away. Besides, the pixel can be adjacent diagonally or perpendicularly as well as horizontally.

Needless to say, a color value other than CIE (1976) L*a*b*color value is also applicable for computing.

Further, the present embodiment is devised for controlling a signal applied to the two dots 802 and 803 adjacent to the defective dot 801. However, the present invention is not limited to this arrangement. Control may be exercised on a signal applied to two pixels which are not adjacent but close to the defective dot. Moreover, control may be exercised on a signal applied to a single dot, not two dots, around the defective dot. Furthermore, a signal applied to three or more dots may be controlled.

The following discusses an example in which a single dot is controlled and an example in which four dots are controlled.

① a single dot is controlled

Figure 13:
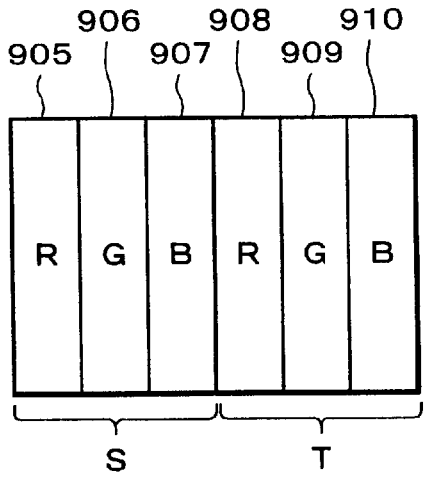
FIG. 13 is an explanatory drawing showing another example of control exercised on a signal which is applied to a dot adjacent to a defective dot.

Referring to FIG. 13, when an R dot 908 of a pixel T is defective, only a G dot 909 of the pixel T is controlled so as to make a correction by minimizing a luminance difference $\Delta L^*$.

Here, original inputs to a B dot 907 of the pixel S, R and G dots 908 and 909 of the pixel T are represented by $B_1$, $R_1$, and $G_1$. Outputs to the dots are represented by $B_2$, $R_2$, and $G_2$.

According to the equation (1), which is a transformation equation of (R, G, B)→(X, Y, Z); the equation (2), which is an equation of (L*, a*, b*); and $Y_1=Y_2$, $R_2=0$, and $B_2=B_1$, it is possible to compute the output $G_2$ to the G dot 909 as follows.

$$Y_R\left(\frac{R_1}{255}\right)^{\gamma R}+Y_G\left(\frac{G_1}{255}\right)^{\gamma G}=Y_G\left(\frac{G_2}{255}\right)^{\gamma G}$$

$$\Rightarrow G_2=255\left\{\frac{Y_R\left(\frac{R_1}{255}\right)^{\gamma R}+Y_G\left(\frac{G_1}{255}\right)^{\gamma G}}{Y_G}\right\}^{\frac{1}{\gamma G}}$$

② four dots are controlled

Referring to FIG. 13 again, when the R dot 908 of a pixel T is defective, G·B dots 906 and 907 of the pixel S and G·B dots 909 and 910 of the pixel T are controlled so as to make a correction by minimizing a luminance difference $\Delta L^*$.

Here, when original inputs to an RGB dot of the pixel S and an RGB dot of the pixel T are represented by ($R_{S1}$, $G_{S1}$, $B_{S1}$) ($R_{T1}$, $G_{T1}$, $B_{T1}$) and outputs to the dots are represented by ($R_{S2}$, $G_{S2}$, $B_{S2}$) ($R_{T2}$, $G_{T2}$, $B_{T2}$), the following relationship is established in the same manner as the equation (1).

$$X_{Si}=100\left\{X_R\left(\frac{R_{Si}}{255}\right)^{\gamma R}+X_G\left(\frac{G_{Si}}{255}\right)^{\gamma G}+X_B\left(\frac{B_{Si}}{255}\right)^{\gamma B}\right\}\ (i=1.2)$$

$$X_{Ti}=100\left\{X_R\left(\frac{R_{Ti}}{255}\right)^{\gamma R}+X_G\left(\frac{G_{Ti}}{255}\right)^{\gamma G}+X_B\left(\frac{B_{Ti}}{255}\right)^{\gamma B}\right\}\ (i=1.2)$$

$Y_{Si}$, $Y_{Ti}$, $Z_{Si}$, and $Z_{Ti}$ can be defined in the same manner.

Moreover, according to the equation (2), the following relationship is established.

$$L^*_{Si}=116\left(\frac{Y_{Si}}{Y_n}\right)^{\frac{1}{3}}-16\quad\left(\frac{Y_{Si}}{Y_n}>0.008856\right)$$

$$L^*_{Si}=903.29\left(\frac{Y_{Si}}{Y_n}\right)\quad\left(\frac{Y_{Si}}{Y_n}\le 0.008856\right)$$

$L^*_{Ti}$, $a^*_{Si}$, $a^*_{Ti}$, $b^*_{Si}$, and $b^*_{Ti}$ can be defined in the same manner.

Besides, an original color value ($L^*_{avg1}$, $a^*_{avg1}$,$b^*_{avg1}$), which is an average of the two pixels S·T, is represented by:

$$L^*_{avg1}=(L^*_{S1}+L^*_{T1})/2$$

$$a^*_{avg1}=(a^*_{S1}+a^*_{T1})/2$$

$$b^*_{avg1}=(b^*_{S1}+b^*_{T1})/2$$

An actual color value ($L^*_{avg2}$, $a^*_{avg2}$, $b^*_{avg2}$), which is an average of the two pixels S·T, is represented by:

$$L^*_{avg2}=(L^*_{S2}+L^*_{T2})/2$$

$$a^*_{avg2}=(a^*_{S2}+a^*_{T2})/2$$

$$b^*_{avg2}=(b^*_{S2}+b^*_{T2})/2$$

Thus, in the same manner as the operation circuit 804, the values of the $G_{S2}$, $B_{S2}$, $G_{T2}$, and $B_{T2}$ are computed so as to satisfy $L^*_{avg2}-L^*_{avg1}=0$ and so as to minimize $|a^*_{avg2}-a^*_{avg1}|$ and $|b^*_{avg2}-b^*_{avg1}|$. The values are computed as outputs to the dots 906, 907, 909, and 910.

As described above, control may be exercised on a single dot or three or more dots.

EMBODIMENT 5

Referring to FIGS. 14 to 26, the following explanation describes still another embodiment of the present invention. Here, for convenience of explanation, those members that have the same functions and that are described in the above embodiments are indicated by the same reference numerals and the description thereof is omitted.

Figure 14:
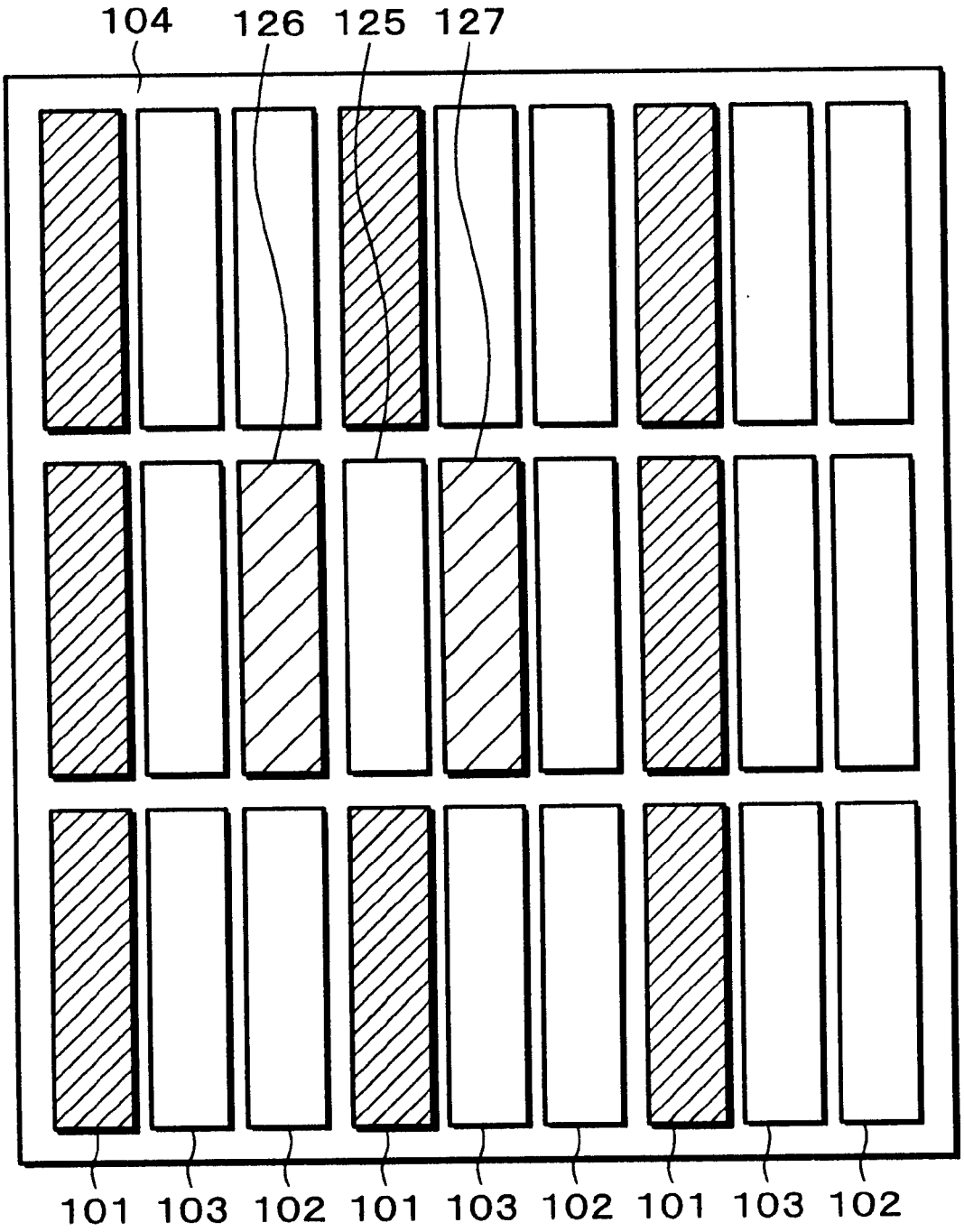
FIG. 14 is an explanatory drawing showing control exercised on a signal which is applied to two dots adjacent to a defective dot in a display panel, according to still another embodiment of the present invention.

FIG. 14 is an explanatory drawing showing a part around a defective dot in a display panel of the present embodiment.

In FIG. 14, 101, 102, and 103 respectively represent red, blue, and green dots. 104 represents a black matrix. Colors are aligned in longitudinal stripes. In FIG. 14, hatched parts are illuminated parts. FIG. 14 is to an enlarged view of a surface of a display device, that is entirely illuminated in red. Namely, the following explanation is provided on the assumption that only the red dots 101 are entirely illuminated.

In FIG. 14, assuming that a red dot 125 is defective and is turned into a black spot, although the entire surface needs to be illuminated, only the defective dot cannot be illuminated. Therefore, irregular colors appear on this part, resulting in deterioration in picture quality.

In the present embodiment, control is exercised on a signal applied to a blue dot 126 and a green dot 127, which are adjacent to the defective red dot 125, so as to reduce a display defect caused by the defective dot 125. Namely, when the red dot 125 is turned into a black spot due to an inevitable defect, regarding the blue dot 126 and the green dot 127 which are adjacent to the defective dot, an input signal is controlled so as to virtually generate original brightness and color of the defective dot 125 around it. Thus, visual deterioration can be reduced. FIG. 14 shows by hatching that a signal controlled in this manner is applied to illuminate the blue dot 126 and the green dot 127.

Incidentally, as described above, FIG. 3 shows a spacial frequency property in vision.

FIG. 3 shows that the visual response of contrast is about three to five times larger in band than response of red-green and yellow-blue.

Measurement examples other than Sakata et al. are available regarding a spacial frequency response in vision. Generally, the response of contrast is about several times larger in band than that of a color. Namely, a change in fine colors is generally less distinguishable than a change in fine contrast.

Thus, in the present embodiment, a signal applied to the blue dot 126 and the green dot 127 is controlled such that a sum of luminance of the blue dot 126 and the green dot 127 is virtually equal to a sum of original luminance, that is obtained based on a signal inputted to the defective dot 125 and the adjacent dots 126 and 127, and such that a color difference is reduced (preferably to a minimum) between a) a color obtained by illumination of the blue dot 126 and the green dot 127 and b) an original color obtained based on a signal inputted to the defective dot 125 and the adjacent dots 126 and 127. To be specific, based on the color signal inputs to the dots 125 to 127, an operation circuit 302 (described later) performs the following operation so as to determine a signal applied to the adjacent dots 126 and 127.

Here, input luminance is represented by (R1, G1, B1), which is an original luminance obtained by a signal inputted to the defective dot 125 and the adjacent dots 126 and 127. The luminance after the above control (after correcting a defect) is represented by (R2, G2, B2) regarding the defective dot 125, the green dot 127, and the blue dot 126. In this case, the present embodiment computes the luminance values G2 and B2 as follows, which correspond to signals applied to the green dot 127 and the blue dot 126.

Namely, (G2, B2) corresponding to (R1, G1, B1) is computed such that a luminance after control is virtually equal to an arbitrary input luminance (R1, G1, B1) and such that a difference is reduced (preferably to a minimum) between a) an original color composed of the dots 125 to 127 and b) a color obtained after control. The computing is carried out in a 2-step algorism as follows.

1) Firstly, with respect to an input luminance (R1, G1, B1), an optimal G2 is computed, namely, G2 is computed so as to satisfy a luminance difference of $\Delta L^*=0$ and a minimum (min) color difference of $\Delta E^*$.

2) Next, with respect to the obtained G2, B2 is computed so as to satisfy $\Delta L^*=0$.

Here, in the present embodiment, the foregoing CIE (1976) L*a*b*color difference is used for the color difference $\Delta E^*$.

Firstly, the following experiment was conducted to find the tendency of an optimal G2 which is computed in 1). Namely, when G1 and B1 were fixed and R1 was changed, a change in G2 was studied. As shown in FIGS. 15 to 19, when the G1 remains the same, an R1-G2 graph, which shows a relationship between an R1 value and an optimal G2 value corresponding to the R1 value, illustrates the same tendency regardless of a B1 value. In other words, an optimal G2 depends only on G1 and R1 but hardly depends on B1.

Figure 15:
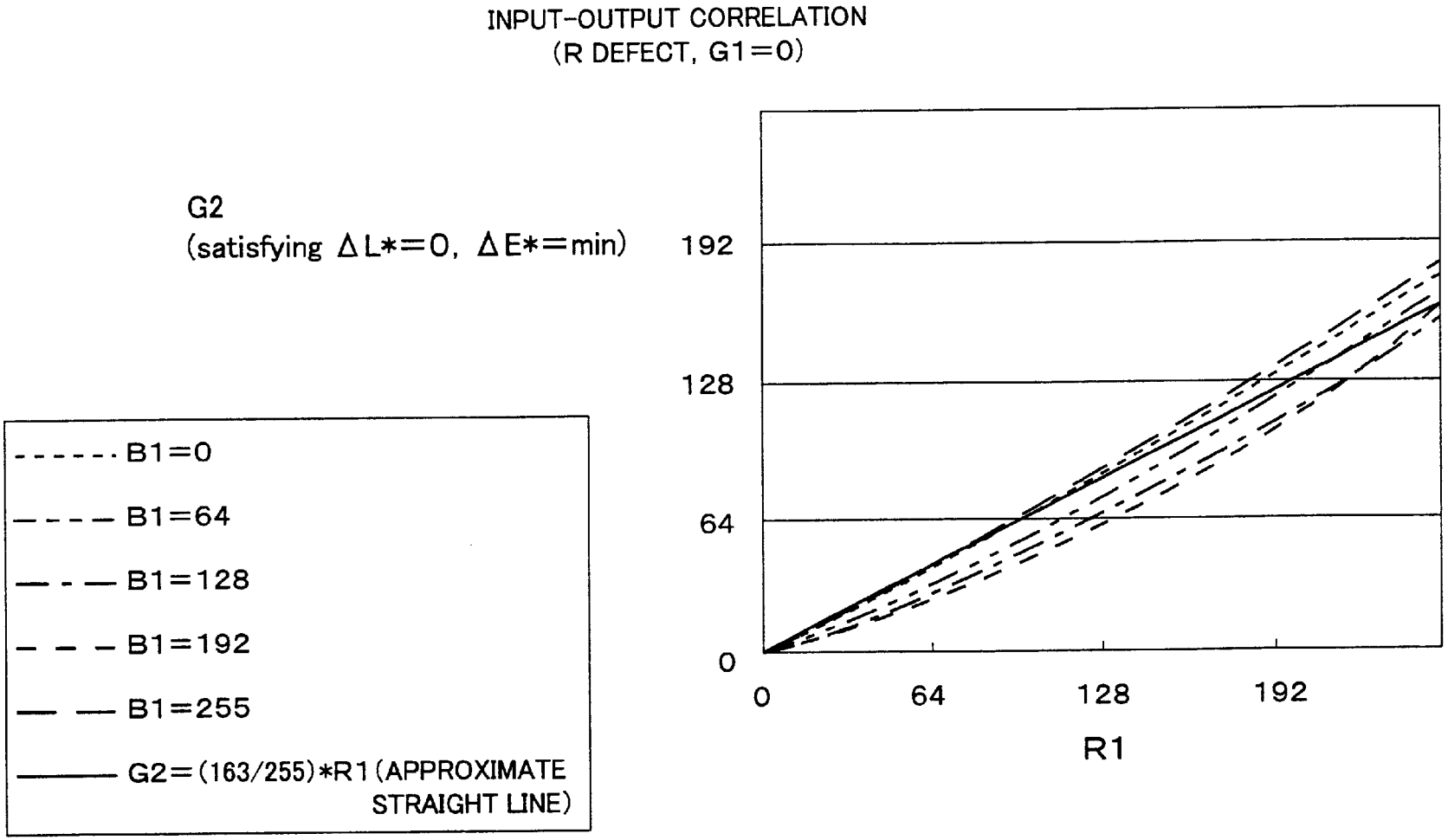
FIG. 15 is an R1-G2 graph showing a relationship between an R1 value and an optimum G2 value corresponding to the R1 in the case of G1=0.
Figure 16:
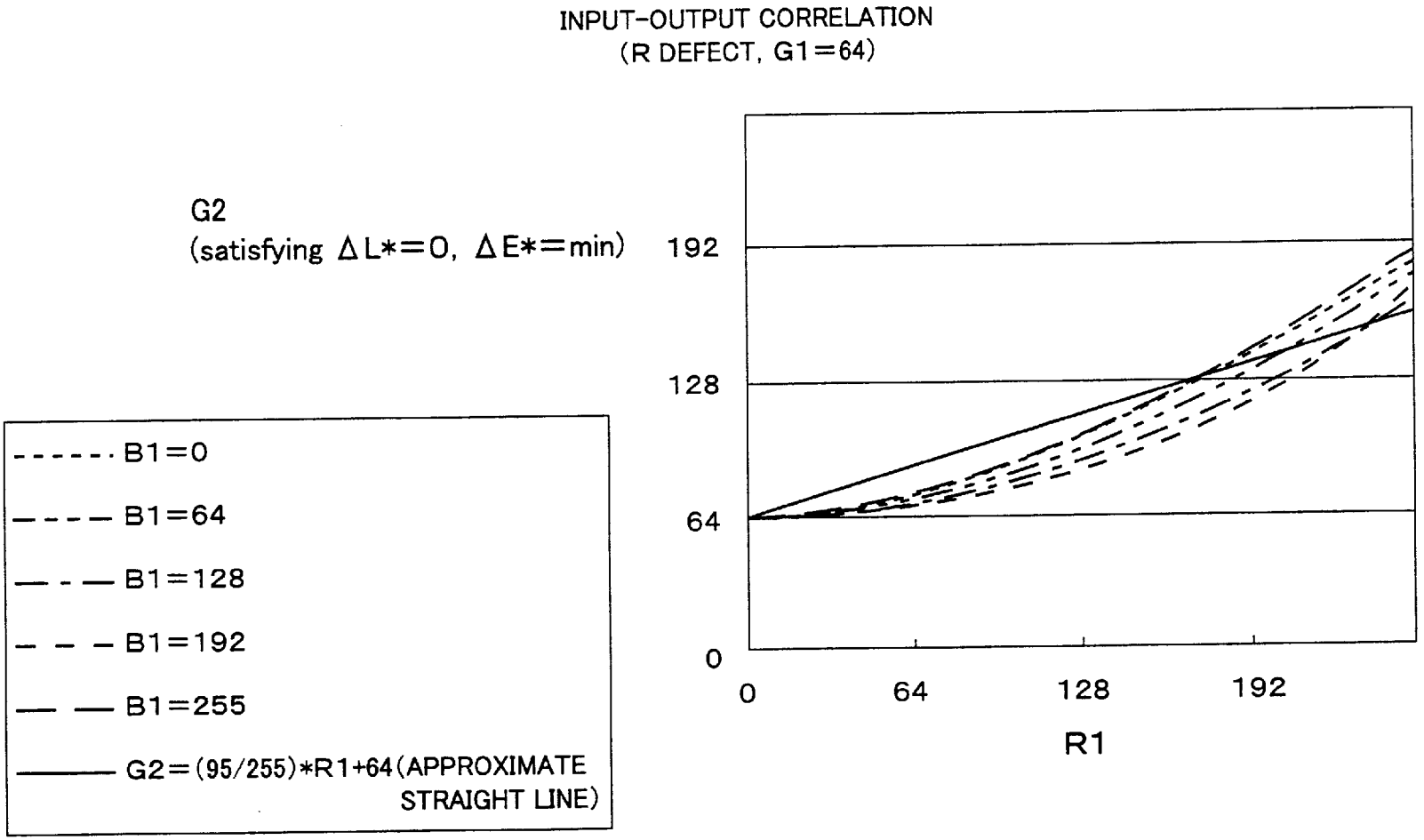
FIG. 16 is an R1-G2 graph showing a relationship between an R1 value and an optimum G2 value corresponding to the R1 in the case of G1=64.
Figure 17:
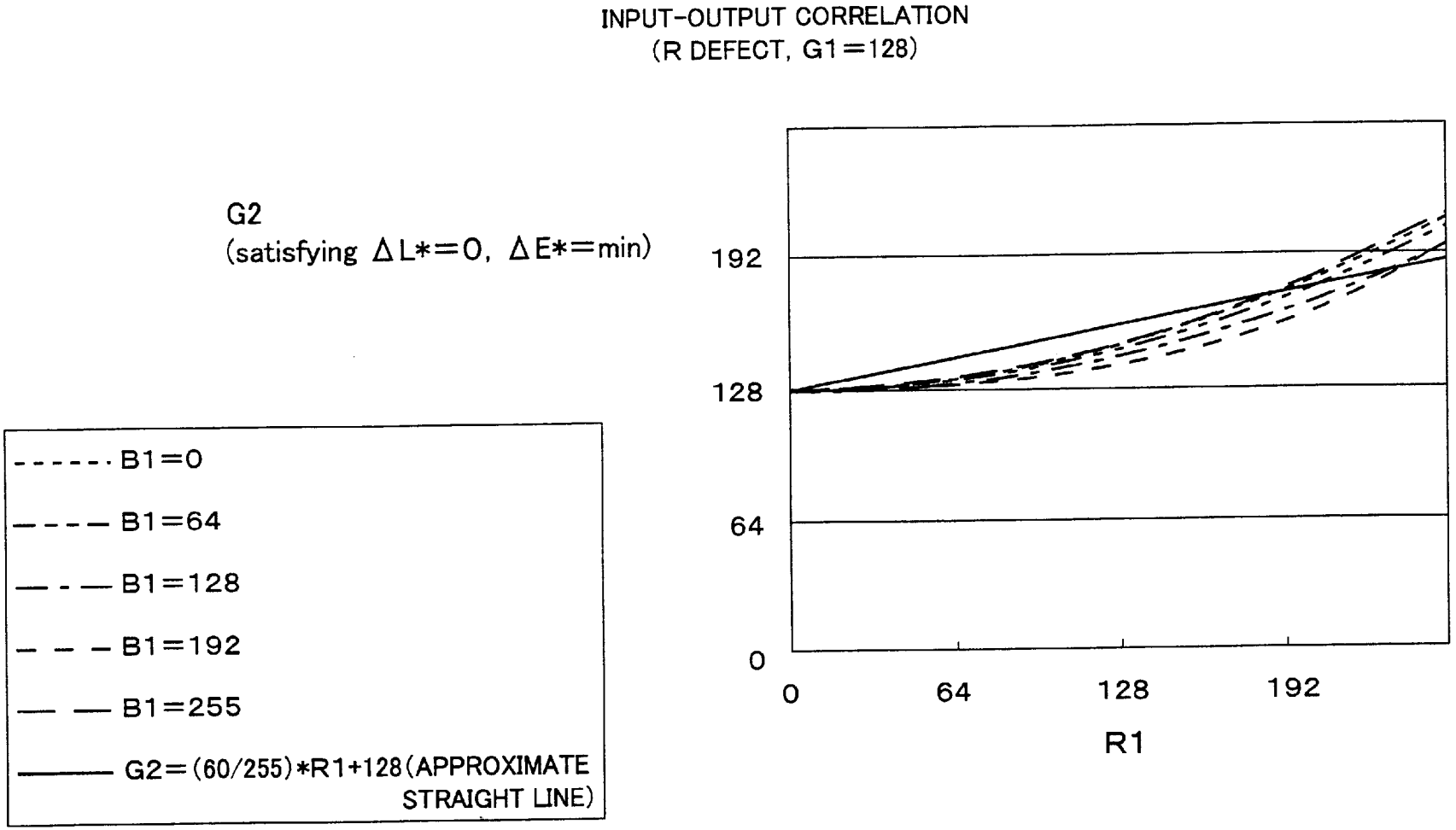
FIG. 17 is an R1-G2 graph showing a relationship between an R1 value and an optimum G2 value corresponding to the R1 in the case of G1=128.
Figure 18:
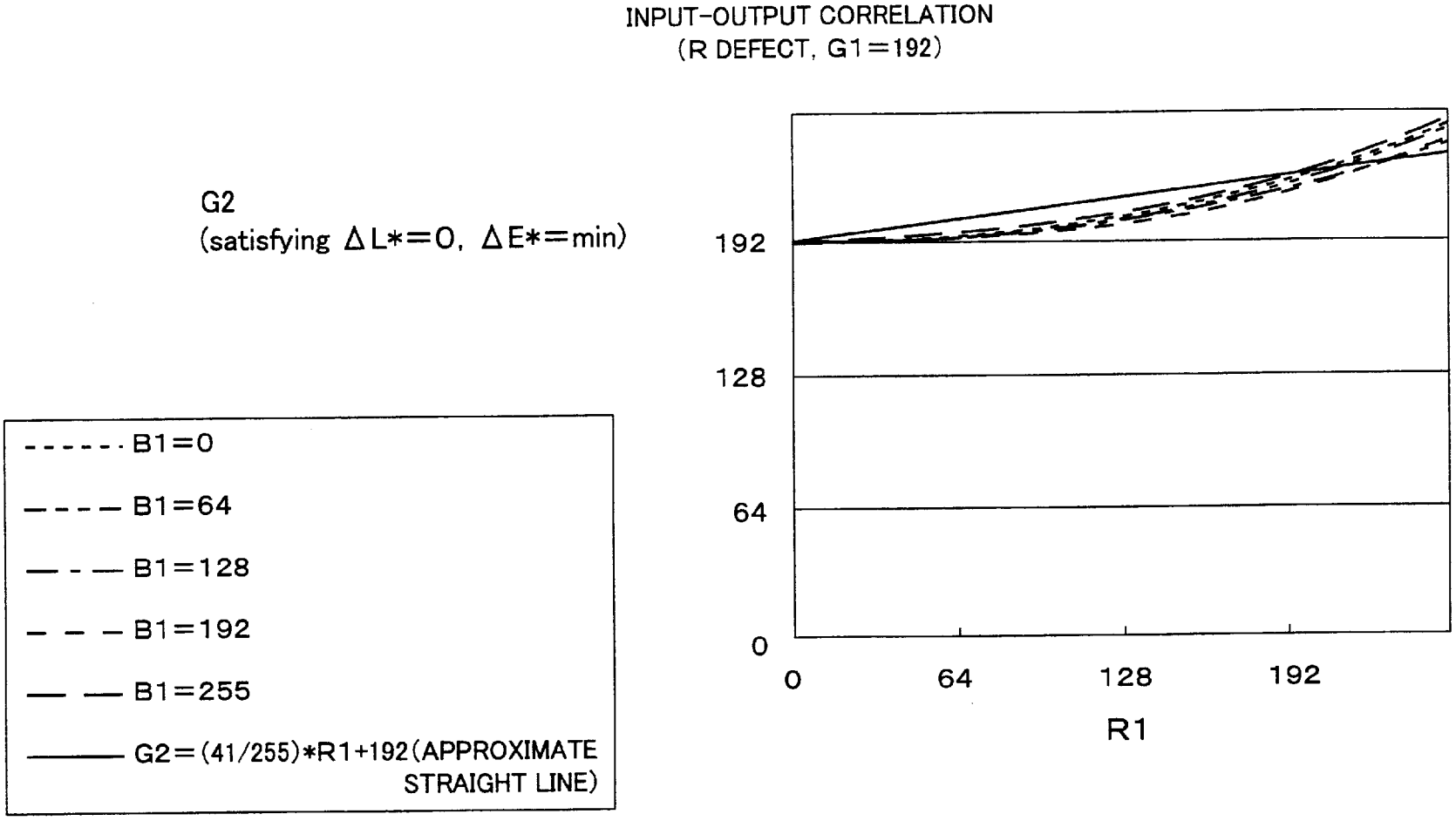
FIG. 18 is an R1-G2 graph showing a relationship between an R1 value and an optimum G2 value corresponding to the R1 in the case of G1=192.
Figure 19:
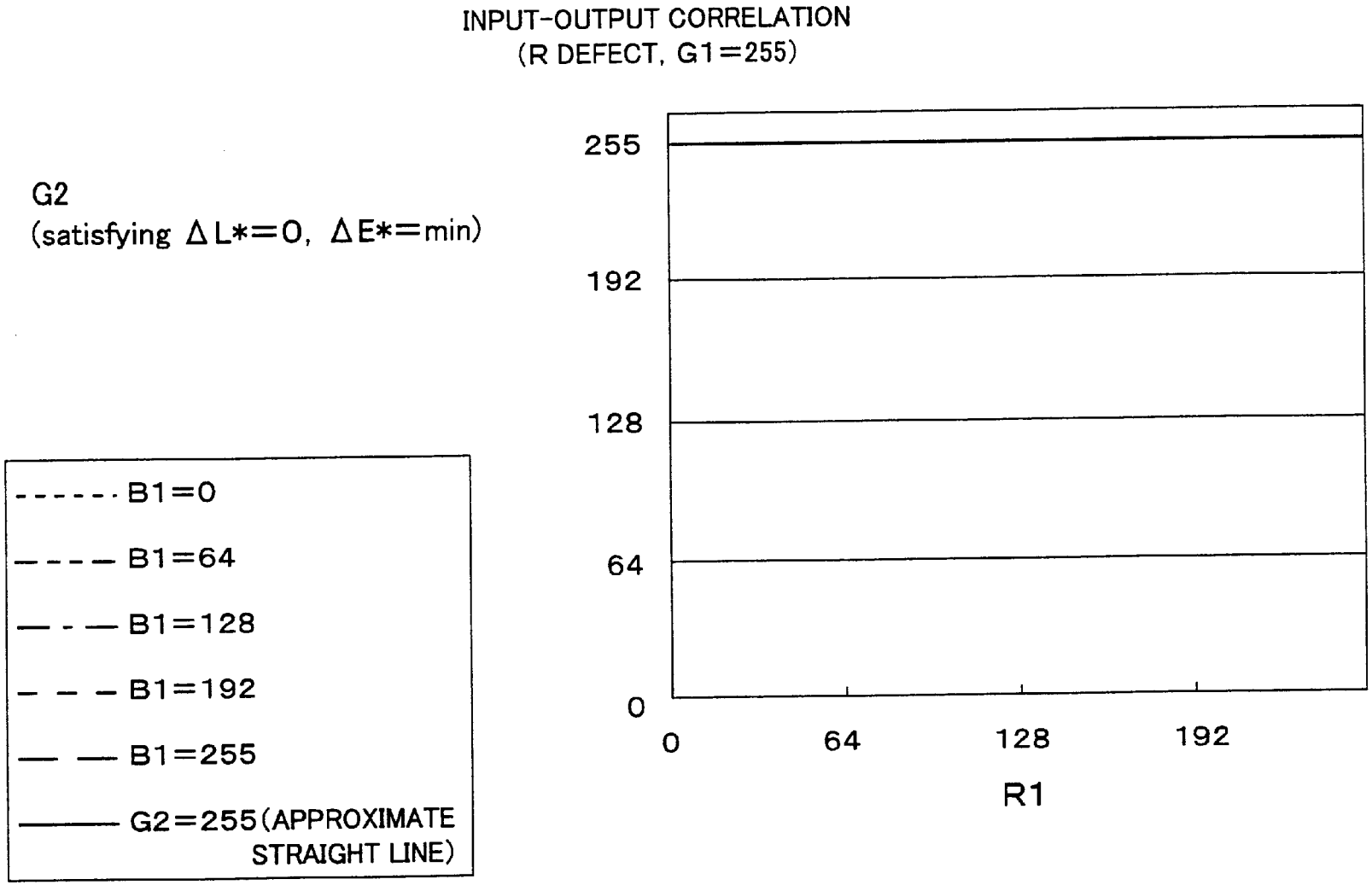
FIG. 19 is an R1-G2 graph showing a relationship between an R1 value and an optimum G2 value corresponding to the R1 in the case of G1=255.

Besides, G1=0 is shown in FIG. 15, G1=64 in FIG. 16, G1=128 in FIG. 17, G1=192 in FIG. 18, and G1=255 in FIG. 19. Each RGB is displayed under an 8-bit (256 levels of gray) condition.

Hence, according to the experimental result, an approximate straight line is obtained from the R1-G2 graph, which corresponds to each of the input value G1. And then, G2 is obtained based on the approximate straight line. Namely, G2 is obtained from input values G1 and R1 based on straight line approximation. To be specific, G2 is computed according to the following equation (5).

$$G2=a(G1)\times R1+G1 \tag{5}$$

Here, a(G1) indicates inclination of an approximate straight line. And then, the inclination a(G1) is determined by a G1-a(G1) graph of FIG. 20, which shows a relationship between a G1 value and an inclination a(G1) value corresponding to the G1 value. In addition, as shown in the following Table 1, the inclination a(G1) of the approximate straight line indicates inclination of each of the approximate straight lines shown in FIGS. 15 to 19. The G1-a(G1) graph is obtained from the foregoing experimental result.

TABLE 1

| $G_1$ | 0 | 64 | 128 | 192 | 255 |
|---|---|---|---|---|---|
| $a(G_1)$ | $\frac{163}{255}$ | $\frac{95}{255}$ | $\frac{60}{255}$ | $\frac{41}{255}$ | 0 |

As earlier mentioned, G2 is determined by computing the function (here, the equation (5) indicating the approximate straight line) obtained in the R1-G2 graph. Hence, a value of G2 can be determined by relatively simple computing, thereby simplifying the circuit construction.

Here, as will be described later, an inclination a(G1) may be computed using approximate values including 0 and $1/2^n$ (here, n is an integer of 0 or more). In this case, the circuit is formed as a bit shift circuit, thereby further simplifying the circuit construction.

Moreover, in the method of computing B2 in 2), B2 is obtained according to the following equation (6), which is determined by a definition equation of CIE (1976) L*a*b*color value. Namely, according to $\Delta L^*=0 \Leftrightarrow L_1^*=L_2^* \Leftrightarrow Y_1=Y_2$, and $R_2=0$, the following relationship is established.

$$Y_R\left(\frac{R_1}{255}\right)^{\gamma R}+Y_G\left(\frac{G_1}{255}\right)^{\gamma G}+Y_B\left(\frac{B_1}{255}\right)^{\gamma B}= Y_G\left(\frac{G_1}{255}\right)+Y_B\left(\frac{B_2}{255}\right)^{\gamma B} \Longrightarrow B_2 = 255\left\{\frac{Y_R\left(\frac{R_1}{255}\right)^{\gamma R}+Y_G\left(\frac{G_1}{255}\right)^{\gamma G}+Y_B\left(\frac{B_1}{255}\right)^{\gamma B}-Y_G\left(\frac{G_2}{255}\right)^{\gamma G}}{Y_B}\right\}^{\frac{1}{\gamma B}} \tag{6}$$

The G2 and B2 computed in the above manner are respectively applied to the green dot 127 and the blue dot 126, that are adjacent to the defective dot 125, so as to virtually generate original color and contrast of the defective dot 125 around it, thereby reducing a display defect caused by the defective dot 125.

In the above example, a defective dot is red (R). Additionally, in the case of blue (B) and green (G) dots as well, a signal applied to two dots, which are adjacent to the defective dot, may be computed in the same manner based on an input signal.

Figure 25:
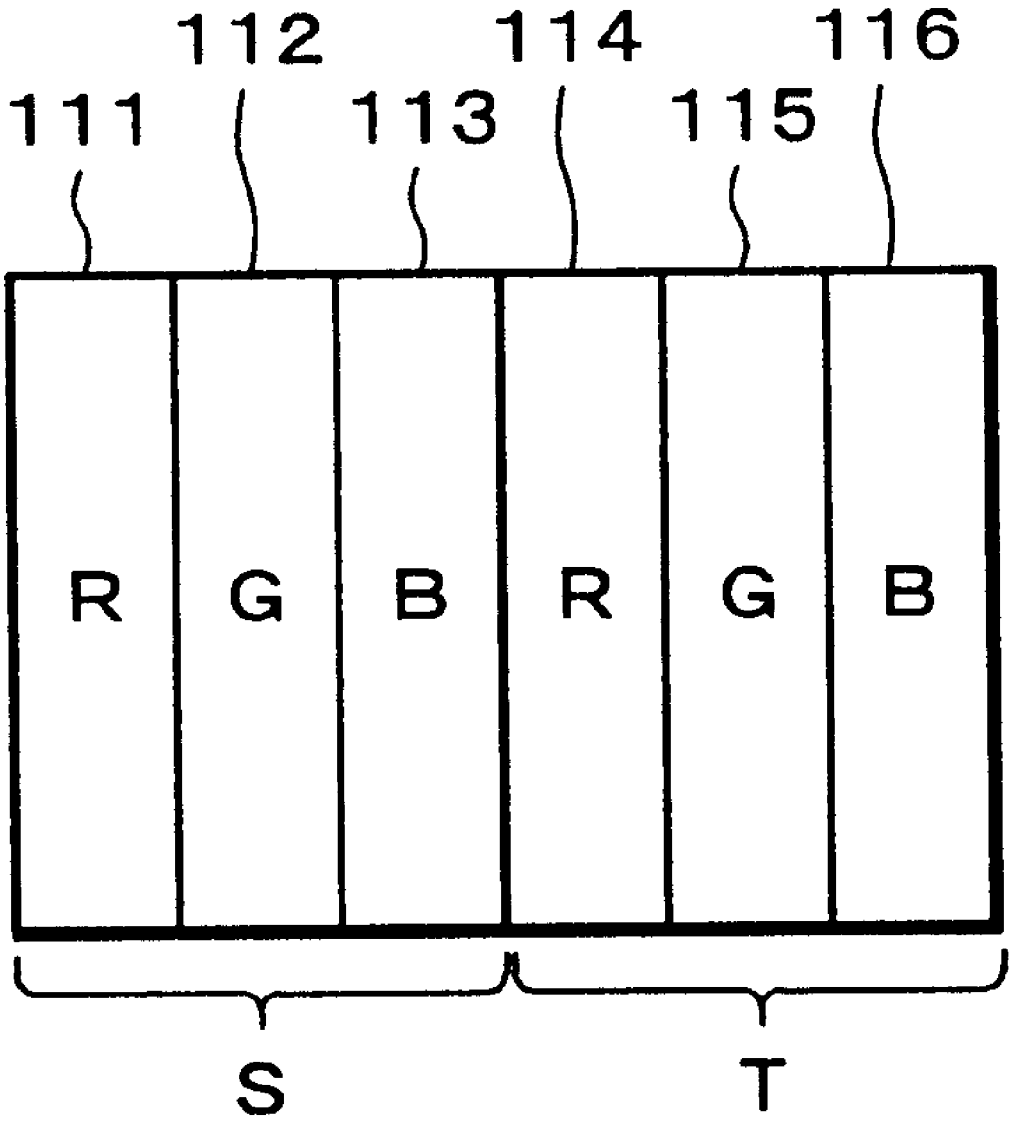
FIG. 25 is an explanatory drawing showing another example of control exercised on a signal which is applied to a dot adjacent to a defective dot.

In the following example, FIG. 25 shows adjacent pixels S·T. When a blue dot 113 is defective, control is exercised on a signal applied to two dots 112 and 114 adjacent to the dot 113.

Here, input luminance is represented by (G1, B1, R1), which is an original luminance obtained based on a signal inputted to the green dot 112, the defective dot 113 and the red dot 114. The luminance after the above control (after correcting a defect) is represented by (G2, B2, R2) regarding the green dot 112, the defective dot 113, and the red dot 114. In this example, luminance values G2 and R2 corresponding to signals applied to the green dot 112 and red dot 114 are computed in a 2-step algorism as follows.

1) Firstly, with respect to input luminance (G1, B1, R1), an optimal G2 is computed, namely, G2 is computed so as to satisfy a luminance difference of $\Delta L^*=0$ and a minimum (min) color difference of $\Delta E^*$.

2) Next, with respect to the obtained G2, R2 is computed so as to satisfy $\Delta L^*=0$.

To be specific, the luminance values are computed as follows.

When the blue (B) dot is defective, the optimal G2 depends on only on G1 and B1 but hardly on R1. Thus, in the same manner as the defective red (R) dot, G2 is computed by the following equation (7).

$$G2=b(G1)\times B1+G1 \tag{7}$$

Here, b(G1) indicates inclination of an approximate straight line as in the case of the a(G1). The b(G1) can be obtained from experimental results and so on.

Moreover, in the method of computing R2 in 2), R2 is obtained according to the following equation (8), which is determined by a definition equation of CIE (1976) L*a*b*color value. Namely, according to $\Delta L^*=0 \Leftrightarrow L_1^*=L_2^* \Leftrightarrow Y_1=Y_2$, and $B_2=0$, the following relationship is established.

$$Y_R\left(\frac{R_1}{255}\right)^{\gamma R}+Y_G\left(\frac{G_1}{255}\right)^{\gamma G}+Y_B\left(\frac{B_1}{255}\right)^{\gamma B}= Y_R\left(\frac{R_2}{255}\right)^{\gamma R}+Y_G\left(\frac{G_2}{255}\right)^{\gamma G} \Longrightarrow R_2 = 255\left\{\frac{Y_R\left(\frac{R_1}{255}\right)^{\gamma R}+Y_G\left(\frac{G_1}{255}\right)^{\gamma G}+Y_B\left(\frac{B_1}{255}\right)^{\gamma B}-Y_G\left(\frac{G_2}{255}\right)^{\gamma G}}{Y_R}\right\}^{\frac{1}{\gamma R}} \tag{8}$$

The G2 and R2 obtained in the above manner are respectively applied to the green dot 112 and the red dot 114.

In the present embodiment, the operation is carried out according to CIE (1976) L*a*b*color value; however, the present invention is not limited to this color value. For instance, CIE (1976) L*u*v*color value, CIELab97s color value and the like are also applicable for operation. Any value is basically applicable as long as it obtains a color perceptible to the human eye.

Furthermore, in the present embodiment, regarding a difference in luminance as well as color, a sum of two dots adjacent to the defective dot becomes virtually equal to a sum of original luminance (namely, luminance difference $\Delta L^*=0$) by controlling a signal applied to the adjacent two dots. The sum of original luminance is based on input signals applied to the defective dot and the adjacent two dots. Additionally, when controlling a signal applied to the adjacent dots, only a color difference may be reduced.

Further, in the present embodiment, the equation (5) indicating an approximate straight line is used as a function obtained from the R1-G2. However, the present invention is not particularly limited to this approximate straight line. For example, a function which is more approximate to an original graph (relationship between R1 and optimal G2) can be adopted using LUT (lookup table) and the like.

For instance, the equation (5) for computing G2 is $$G2=a(G1)\times R1+G1$$

which, regarding R1, makes approximation by a primary equation (i.e., approximation to a straight line). When the approximation is made by the following higher-degree polynomials (i.e., curve approximation), $$G2=a_2(G1)\times R1^2+a_1(G1)\times R1+G1$$

$$G2=a_3(G1)\times R1^3+a_2(G1)\times R1^2+a_1(G1)\times R1+G1$$

an error can be reduced (closer to an original value) as shown in FIGS. 15 to 19. Here, the coefficients $a_1$, $a_2$, and $a_3$ are functions of G1 and are computed by experiments and so on.

Subsequently, the circuit construction of the present embodiment is discussed.

Figure 21:
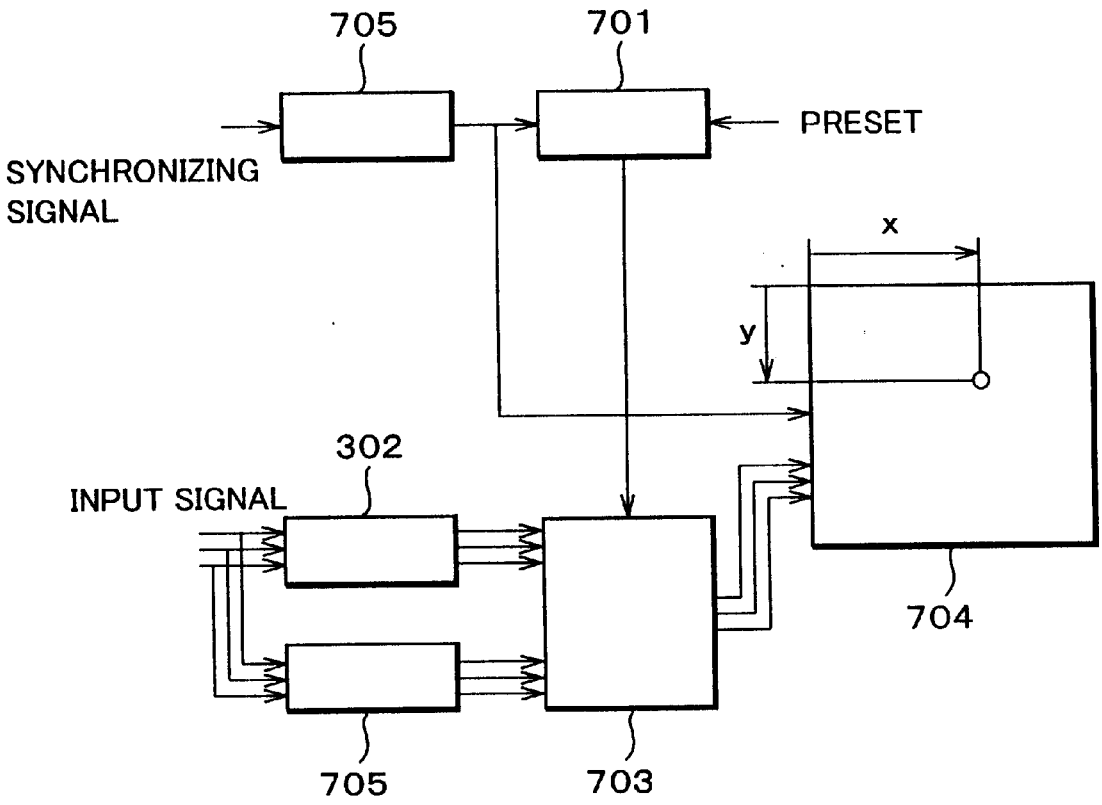
FIG. 21 is a block diagram showing the circuit construction of the above embodiment.

As shown in FIG. 21, the circuit construction of the present embodiment is identical to Embodiment 1; however, an operation circuit (control means) 302 is different from an operation circuit 702 in the following operation.

Figure 22:
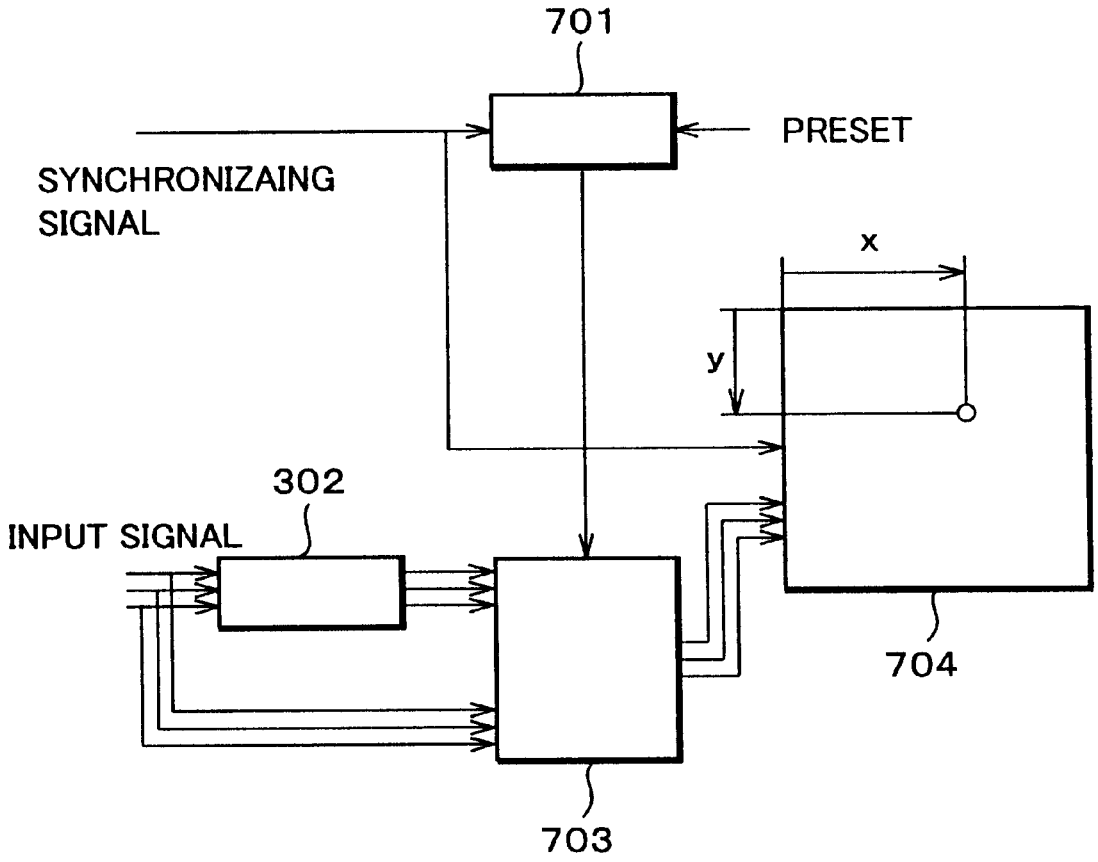
FIG. 22 is a block diagram showing another circuit construction of the above embodiment.

Here, as in Embodiment 1, a delay circuit may be omitted in the circuit construction of the present embodiment as shown in FIG. 22.

In the present embodiment, the operation circuit 302 performs an operation according to the equations (5) and (6) to obtain signal values G2 and B2, which are applied to the two dots 126 and 127 adjacent to the defective dot 125. Hardware such as a CPU and a DSP is applicable.

Figure 23:
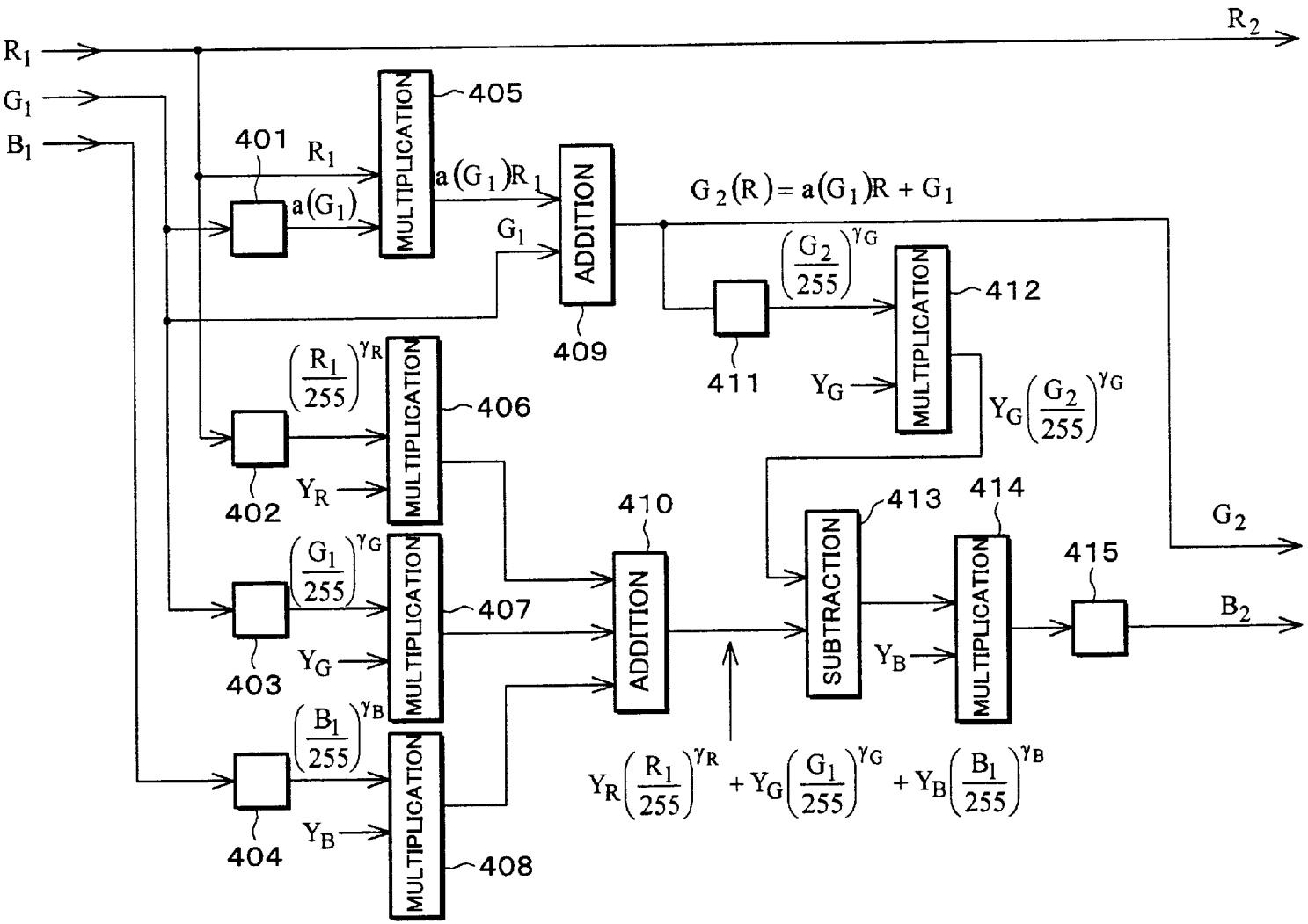
FIG. 23 is a block diagram showing the construction of an operation circuit according to the above embodiment.

Next, referring to FIG. 23, the following explanation discusses the construction of the operation circuit 302. FIG. 23 is a circuit diagram showing the detail of a defective red (R) part in the operation circuit 302. As shown in FIG. 23, the operation circuit 302 is provided with circuits 401, 405, and 409 for performing an operation according to the equation (5), and circuits 402 to 404, 406 to 408, and 410 to 415 for performing an operation according to the equation (6). Here, in FIG. 23, the circuits 401 and 405 correspond to a first circuit, the circuit 409 corresponds to a second circuit, and the circuits 402 to 404, 406 to 408 correspond to a third circuit. Further, the circuits 402 to 404, 411, and 415 perform a power calculation by using LUT (lookup table).

G1 is inputted to the circuit 401, and inclination a(G1) corresponding to G1 is outputted. The circuit 405 is a multiplier. R1 and a(G1) are inputted thereto and a value of a(G1)×R1 is outputted therefrom. The circuit 409 is an adder. Values of G1 and a(G1)×R1 are inputted thereto and a value of a(G1)×R1+G1 is outputted therefrom. This value is outputted from the operation circuit 302 as G2.

Meanwhile, R1 is inputted to the circuit 402, and a value of (R1/255) to the $\gamma_R$th power is outputted therefrom. This value and $Y_R$ are inputted to the multiplier 406, and a value of $Y_R\times(R1/255)$ to the $\gamma_R$th power is outputted therefrom.

In the same manner, G1 is inputted to the circuit 403, and a value of (G1/255) to the $\gamma_G$th power is outputted therefrom. This value and $Y_G$ are inputted to the multiplier 407, and a value of $Y_R\times(G1/255)$ to the $Y_G$th power is outputted therefrom. Further, B1 is inputted to the circuit 404, and a value of (B1/255) to the $\gamma_B$th power is outputted therefrom. This value and $Y_B$ are inputted to the multiplier 408, and a value of $Y_B\times(B1/255)$ to the $\gamma_B$th power is outputted therefrom.

Each of the outputs from the multipliers 406 to 408 is transmitted to the circuit 410. The circuit 410, which serves as an adder, adds values outputted from the multipliers 406 to 408 and outputs the added value to a subtracter 413.

On the other hand, G2 is inputted to the circuit 411 as an output from the adder 409, and the circuit 411 outputs a value of (G2/255) to the $\gamma_G$th power. This value and $Y_G$ are inputted to the multiplier 412, and a value of $Y_G \times (G2/255)$ to the $\gamma_G$th power is outputted therefrom. This value is transmitted to the subtracter 413.

The subtracter 413 subtracts the value of the multiplier 412 from the added value of the adder 410, and outputs the resulting value to a divider 414. $Y_B$ and the value from the subtracter 413 are inputted to the divider 414. The value from the subtracter 413 is divided by $Y_B$ and is outputted from the divider 414. This value is transmitted to the circuit 415.

In the circuit 415, the value to the $1/\gamma_B$th power from the divider 414 is multiplied by 255, and is outputted therefrom. The output value, which has been transmitted from the circuit 415, is outputted as B2 from the operation circuit 302.

Figure 24:
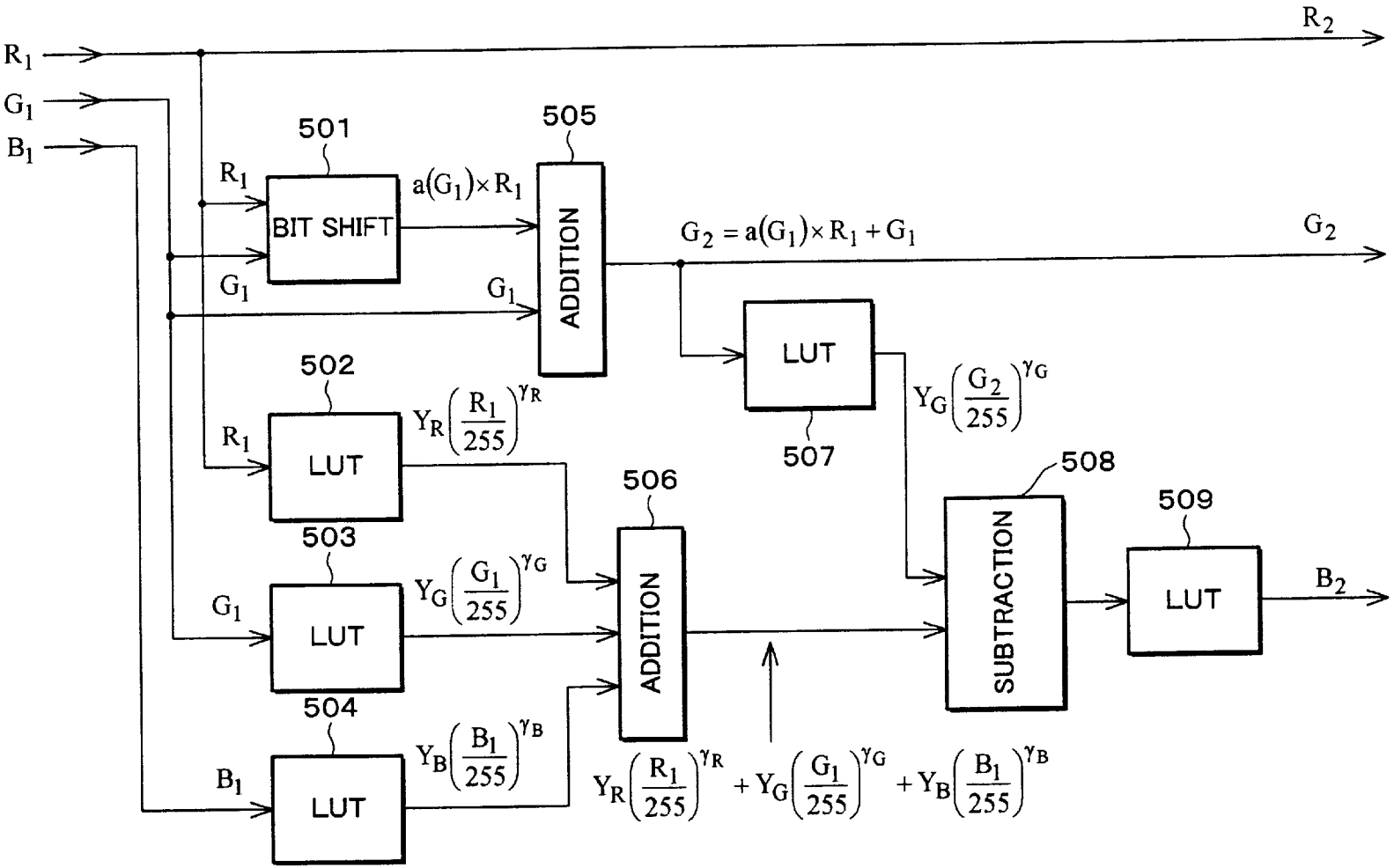
FIG. 24 is a block diagram showing another construction of the operation circuit according to the above embodiment.

Furthermore, the circuit construction of the operation circuit 302 is not limited to the construction shown in FIG. 23. A simpler construction is also applicable. FIG. 24 shows an example of the operation circuit 302 with a simpler construction. In this example, the operation circuit 302 is provided with circuits 501 and 505 for performing an operation according to the equation (5), and circuits 502 to 504, 506 to 509 for performing an operation according to the equation (6). Here, in FIG. 24, the circuit 501 corresponds to a first circuit, the circuit 505 corresponds to a second circuit, and the circuits 502 to 504 correspond to a third circuit. Additionally, the circuits 502 to 504, 507, and 509 perform a power calculation and multiplication by using an LUP and the like.

R1 and G1 are inputted to the circuit 501 serving as a bit shift circuit, a value a(G1)×R1 is computed therein by multiplying R1 by the inclination a(G1), which corresponds to G1, and then, the resulting value is outputted therefrom. The circuit 505 is an adder. G1 and the value a(G1)×R1 are inputted thereto, and a value a(G1)×R1+G1 is outputted. This value is outputted as G2 from the operation circuit 302.

Meanwhile, R1 is inputted to the circuit 502, and a value of $Y_R \times (R1/255)$ to the $\gamma_R$th power is computed and outputted therefrom. In the same manner, G1 is inputted to the circuit 503 and a value of $Y_G \times (G1/255)$ to the $\gamma_G$th powers is outputted therefrom. Further, B1 is inputted to the circuit 504 and $Y_B \times (B1/255)$ to the $\gamma_B$th power is outputted therefrom.

Each of the outputs from the circuits 502 to 504 is transmitted to the circuit 506. The circuit 506 serves as an adder for adding the outputs from the circuits 502 to 504 and outputs an added value to a subtracter 508.

Meanwhile, G2 outputted from the adder 505 is inputted to the circuit 507, and $Y_G \times (G2/255)$ to the $\gamma_G$th power is outputted therefrom. This value is transmitted to a subtracter 508.

The subtracter 508 subtracts the value of the circuit 507 from the added value of the adder 506, and the resulting value is outputted to the circuit 509. After the value from the subtracter 508 is divided by $Y_B$, the value to the $1/\gamma_B$th power is multiplied by 255 in the circuit 509. And then, the circuit 509 outputs the resulting value. The output value from the circuit 509 is outputted as B2 from the operation circuit 302.

Figure 20:
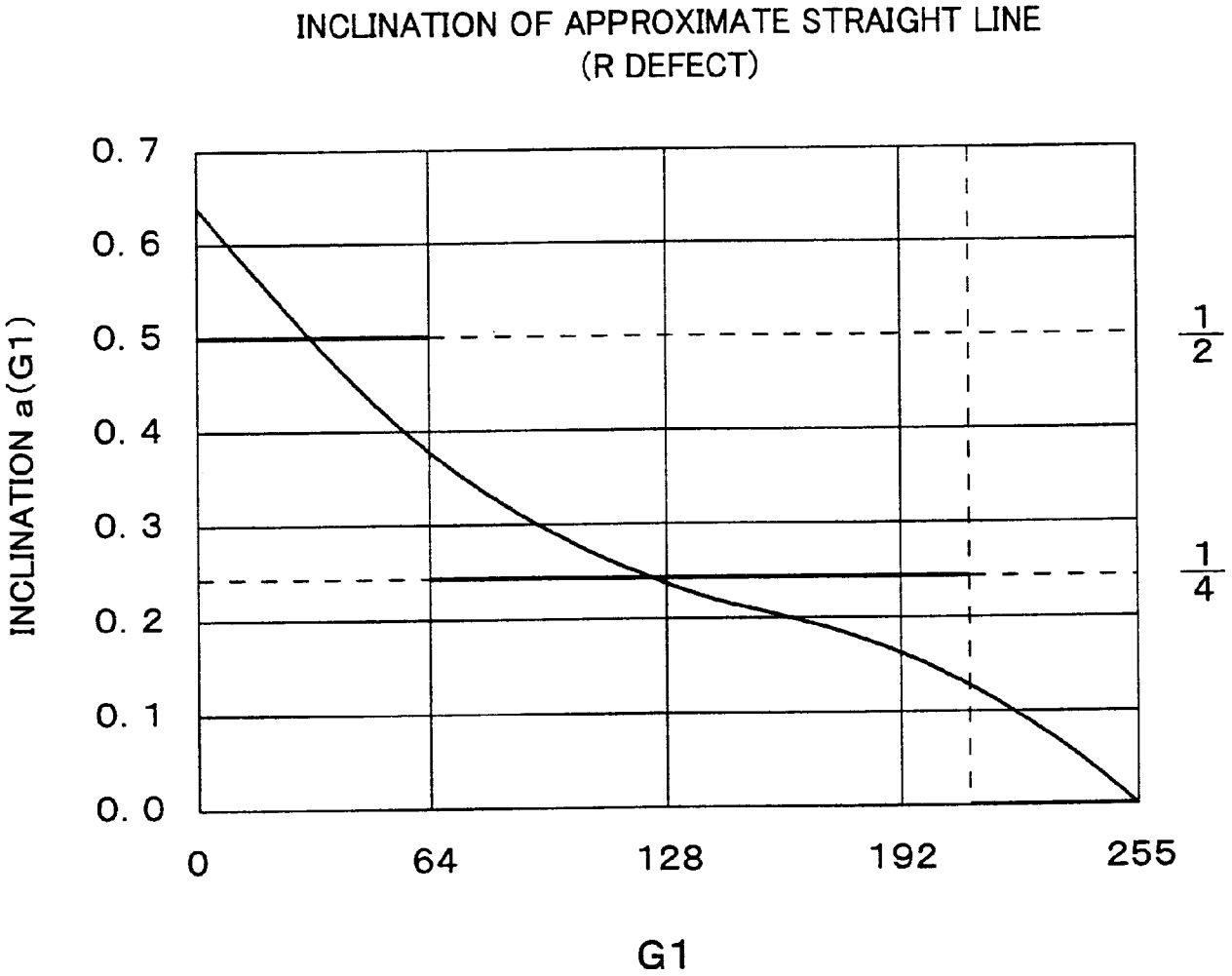
FIG. 20 is a G1-a(G1) graph showing a relationship between a G1 value and an inclination a(G1) value corresponding to G1.

In the example shown in FIG. 24, the bit shift circuit 501 is used as a first circuit. In this case, approximate values including 0 and $1/2^n$ (here, n is an integral of 0 or more) are used as inclination a(G1). For instance, in the case of n=2, as shown in FIG. 20, a value of a(G1) is limited to 0, ½, and ¼. The circuit 501 is realized by a bit shift circuit with one bit in the case of a(G1)=½, and realized by a bit shift circuit with two bits in the case of a(G1)=¼. In this way, approximate values including 0 and $1/2^n$ are used as inclination a(G1), and the circuit 501 can be realized by a simple bit shift circuit.

Further, in the example of FIG. 24, each of the circuits 502 to 504, 507, and 509 serves as an LUT, which includes a multiplier and a circuit for performing a power calculation. The circuit construction is simple as compared with that of FIG. 23.

Figure 26:
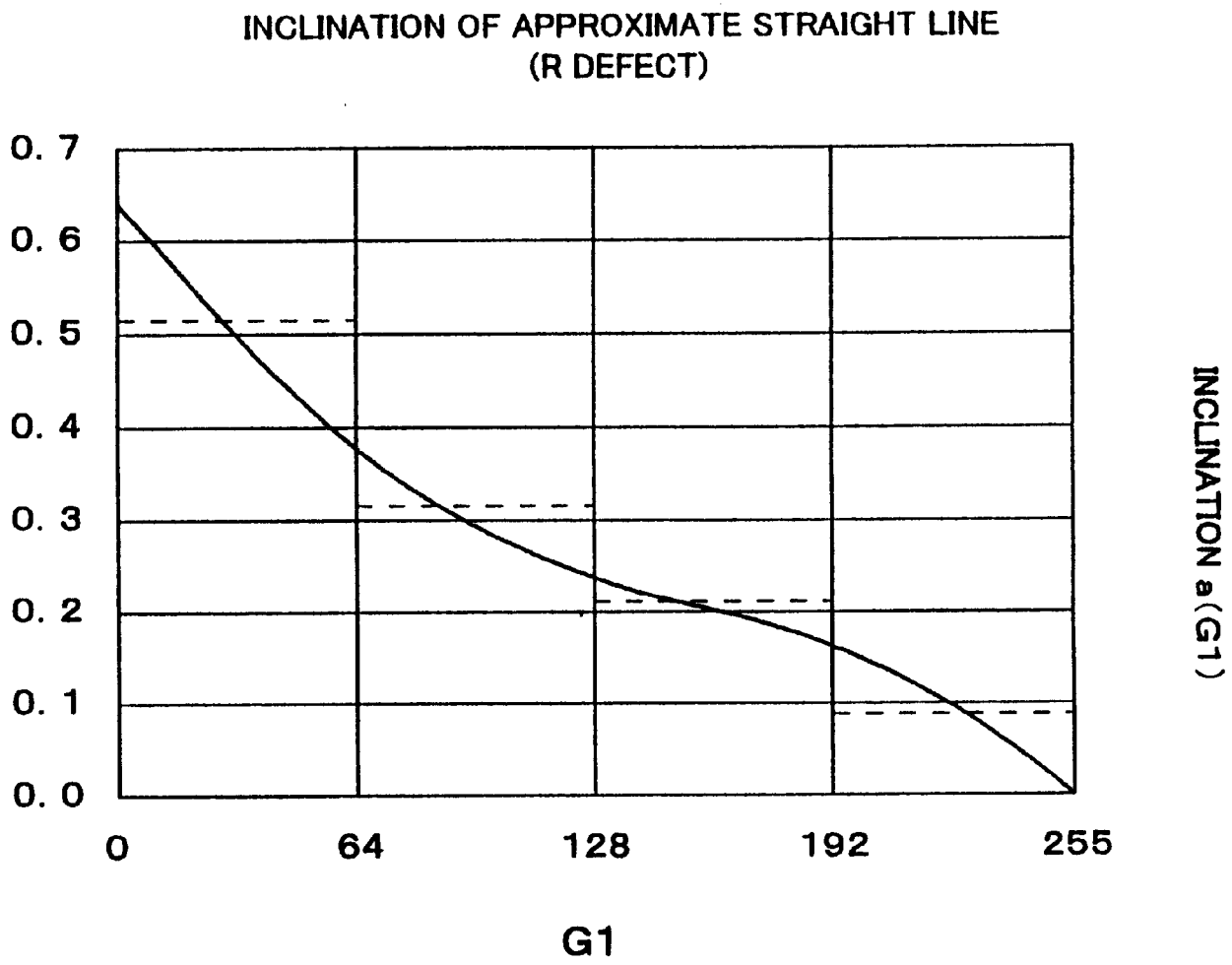
FIG. 26 is a G1-a(G1) graph showing another example in which an approximate value is used as inclination a(G1).

In addition, in the above construction, approximate values including 0 and $1/2^n$ are used as the inclination a(G1). Besides, approximate values which consist of value 0 and value X (the number of value X is $2^n$; here, n is an integral of 1 or more) may be used as inclination a(G1). For example, in the case of n=2, as shown in FIG. 26, a(G1) value is divided into four areas. In each of the areas, an average a(G1) value (indicated by a dotted line) is defined as a(G1), which corresponds to G1 of the area. With this arrangement, the circuit is not formed by the bit shift circuit but a lookup table (LUT).

As described above, in the present embodiment, control is exercised on a signal applied to the blue dot 126 and the green dot 127 such that a difference is reduced (preferably to a minimum) between a) a color obtained by illumination of the blue dot 126 and the green dot 127 and b) an original color obtained by a signal inputted to the defective dot 125, and the adjacent dots 126 and 127.

Besides, signals applied to a plurality of dots may be controlled such that a color obtained by illuminating the plural dots, which are adjacent to a defective dot, is closer to (difference is preferably minimum) an average of a) an original color of a pixel including a defective dot and b) an original color of one or more pixels adjacent to the pixel including the defective dot. In this case, a plurality of dots adjacent to the defective dot may be controlled using the method described in Embodiment 4.

In the present embodiment, control is exercised on a signal applied to two dots adjacent to a defective dot. However, the present invention is not limited to this arrangement. Control may be exercised on a signal applied to two dots which are close but not adjacent to a defective dot.

Furthermore, control may be exercised on a signal applied to three or more dots adjacent to a defective dot. In this case, three or more dots adjacent to the defective dot can be controlled using the method described in "② four dots are controlled" of Embodiment 4.

As earlier mentioned, the present invention requires only a few additional circuits. In the conventional art, when the number of defective dots exceeds the reference number, a panel needs to be discarded. However, according to the present invention, just a few additional circuits allow the discarded panel to be usable. Thus, the larger area, the higher density, and the higher unit price, an overall cost can be reduced more efficiently.

Inevitably, mechanical working with a laser device is not necessary. In the conventional method, it is necessary to analyze a defect, to judge which circuit and how the circuit should be burned off or sintered, and to perform the burning off and sintering. For this reason, a throughput is extremely small.

In contrast, the method of the present invention only needs to set the address of a defective dot in a counter, so that a throughput of correction can be dramatically improved.

Further, the result of the method can be freely selected only by changing a coefficient K and an LUT in an operation circuit. Conventionally, the method using a laser device has only two alternatives of burning off and sintering, so that it is only possible to permanently release the defective dot or bring it into conduction. Therefore, the defective dot is entirely illuminated (luminescent spot defect) or completely unilluminated (black spot defect). However, in the present invention, any correction is possible by selecting a coefficient K and an LUT.

Also, by displaying a color value which is most approximate to an original color value of a pixel including a defective dot, or by displaying a color value which is most approximate to an average of color values of adjacent pixels, it is possible to dramatically reduce the deterioration which remains after correction.

In other words, the present invention is capable of correcting a variety of defects so as to make usable a number of defective products, that have been conventionally discarded, thereby dramatically reducing an overall defective ratio.

As described above, the present invention makes it possible to dramatically reduce the cost as compared with a conventional art, in which either improvement of the manufacturing technology or the use of a laser device and the like requires a large amount of cost so as to increase an overall cost, resulting in an obstacle to wide use.

As mentioned above, a first display device of the present invention, in which dots of three colors constituting a fine pixel are spatially arranged, includes a means for controlling a signal applied to a dot adjacent to an electrically uncontrollable dot, in order to reduce visual deterioration caused by the electrically uncontrollable dot.

In the first display device of the present invention, it is preferable to control a signal applied to n dots (n is an integer of 1 or more) adjacent to an electrically uncontrollable dot such that a sum of luminance of the n dots adjacent to the electrically uncontrollable dot is virtually equal to an original luminance of the electrically uncontrollable dot. With this arrangement, the brightness around the defective dot is virtually equal to original brightness of the defective dot, thereby suppressing visual deterioration (display defect) caused by the defective dot.

In this case, on the assumption that the n dots are not originally illuminated, control is exercised to a signal applied to the n dots adjacent to the electrically uncontrollable dot such that a sum of luminance of the n dots is virtually equal to an original luminance of the electrically uncontrollable dot.

Further, a second display device of the present invention, which has a plurality of pixels, each pixel displaying by dots of at least three colors, includes a control means for controlling a signal applied to one or more dots adjacent to a defective dot in order to compensate for a display defect caused by the defective dot, which is electrically uncontrollable.

According to the above invention, even when a defective dot, which is electrically uncontrollable, occurs in the display device, it is possible to generate brightness virtually equal to original brightness of the defective dot, by controlling a signal applied to one or more dots adjacent to the defective dot. Consequently, it is possible to suppress visual deterioration (display defect) caused by the defective dot. Moreover, the present invention does not cause the foregoing problems that appear in the conventional method using a laser device.

In the second display device of the present invention, it is preferable to control a signal applied to n dots (n is an integer of 1 or more) such that a sum of luminance of the n dots adjacent to the defective dot is virtually equal to a sum of original luminance, that is obtained by input signals to the defective dot and the n dots. With this arrangement, brightness around the defective dot is virtually equal to original brightness of the defective dot, thereby suppressing visual deterioration (display defect) caused by the defective dot.

In the first and second display devices of the present invention, it is preferable to control a signal applied to the n dots so as to reduce a difference (preferably to a minimum) between a) a color obtained by illumination of the n dots (n is an integer of 1 or more) adjacent to the defective dot and b) an original color obtained by a signal inputted to the defective dot and the n dots.

This arrangement makes it possible to generate a color around the defective dot is virtually equal to an original color of the defective dot, thereby suppressing a display defect caused by the defective dot.

In this case, it is preferable to control a signal applied to the n dots so as to reduce CIE (1976) L*a*b*color difference between a) a color obtained by illumination of the n dots adjacent to the defective dot and b) an original color obtained by a signal inputted to the defective dot and the n dots.

In the first and second display devices of the present invention, it is preferable to control a signal applied to the n dots such that a color obtained by illumination of the n dots (n is an integer of 1 or more), which are adjacent to the defective dot, is closer to (preferably virtually equal to) an average of a) an original color of a pixel including the defective dot and b) an original color of one or more pixels adjacent to the pixel.

According to this arrangement, a color around the defective dot is virtually equal to an average of a) an original color of a pixel including the defective dot and b) an original color of one or more pixels adjacent to the pixel, thereby suppressing a display defect caused by the defective dot.

In this case, the above color is preferably represented by CIE (1976) L*a*b*color value.

In the first and second display devices of the present invention, it is preferable to control a signal applied to two of the dots adjacent to the defective dot. Thus, a display defect can be suppressed by a relatively simple control on the two dots.

Here, "two dots adjacent to . . . " means that two dots are adjacent to the defective dot horizontally, vertically, or diagonally.

The first and second display devices of the present invention, each preferably including:

an operation circuit which computes and outputs a signal value applied to a dot adjacent to the defective dot, based on an input signal, in order to compensate for a display defect caused by the defective dot, a switching circuit for receiving a first signal and a second signal and for switching an output between the first signal, which is transmitted from the operation circuit, and the second signal, which does not pass through the operation circuit, and an address detecting circuit for supplying a switching signal to the switching circuit at a timing of displaying a position of the defective dot on a display, wherein the switching circuit outputs the first signal at a timing of inputting the switching signal and outputs the second signal at a timing other than inputting the switching signal.

With this circuit construction, it is possible to control a signal applied to a dot adjacent to the defective dot, thereby suppressing a display defect.

It is preferable to input the second signal via a delay circuit to the switching circuit. This arrangement makes it possible to adjust time delay caused by operation performed by the operation circuit.

When controlling a signal applied to n dots such that a color obtained by illumination of the n dots adjacent to a defective dot is closer to an average of a) an original color of a pixel including the defective dot and b) an original color of one or more pixels adjacent to the pixel, it is preferable to include:

an average color value computing circuit for computing an average color value of a) an original color of a pixel including the defective dot and b) an original color of one or more pixels adjacent to the pixel, and an output circuit for computing and outputting a signal value applied to the n dots such that a color obtained by illumination of the n dots is closer to an average color value obtained by the average color value computing circuit.

With this circuit construction, it is possible to control a signal applied to the n dots adjacent to a defective dot, and a color around the defective dot is virtually equal to an average color of a) an original color of a pixel including the defective dot and b) an original color of one or more pixels adjacent to the defective pixel.

Moreover, in the above arrangement, the average color value computing circuit preferably computes average values of respective color signals of a) a pixel including the defective dot and b) one or more pixels adjacent to the pixel, and computes an average color value based on these average values. This arrangement can further simplify the circuit construction.

Besides, a third display device of the present invention, which has a plurality of pixels, each pixel displaying by dots of at least three colors, includes a control means for controlling a signal applied to the plural dots adjacent to the defective dot such that a difference is reduced between a) a color obtained by illumination of the plural dots and b) an original color obtained by a signal inputted to the defective dot and the plural dots, in order to compensate for a display defect caused by the defective dot which is electrically uncontrollable, wherein the control means performs a computing based on a function, which is obtained by a correlation relationship between an original input signal of the defective dot and a signal value to be applied to one of the plural dots in response to the input signal of the defective dot, so as to determine a signal value applied to the one of the plural dots, and then, the control means computes a signal value applied to another dot.

As the above function, it is preferable to use an approximate straight line, which is obtained by a correlation relationship between an original input signal of the defective dot and a signal value to be applied to the one of the plural dots in response to the input signal of the defective dot. This arrangement can realize simpler operation.

Additionally, as the above function, it is possible to use a function which is approximate to the above correlation relationship obtained by experimental results, by using an LUP (lookup table) and the like.

The color difference is preferably represented by CIE (1976) L*a*b*color difference value.

In the third display device of the present invention, the control means preferably controls signals applied to the plural dots such that a sum of luminance of the plural dots is virtually equal to a sum of original luminance obtained by signals inputted to the defective dot and the plural dots.

According to this arrangement, the luminance around the defective dot is virtually equal to an original luminance of the defective dot, thereby suppressing a display defect caused by the defective dot.

In the third display device of the present invention, the inclination of the approximate straight line is preferably determined according to an input signal value of the one of the plural dots. This arrangement makes it possible to determine the inclination of the approximate straight line suitably to an input signal value of the one of the plural dots.

In the third display device of the present invention, it is preferable to use approximate values of 0 and $1/2^n$ (n is an integer of 0 or more) as the inclination, thereby further simplifying the circuit construction.

In the third display device of the present invention, the control means preferably includes 1) a first circuit which determines inclination of the approximate straight line according to an input signal value of the one of the plural dots and multiplies the inclination by an input signal value of the defective dot; and 2) a second circuit which adds a) the input signal value of the one of the plural dots to b) the value computed in the first circuit, and outputs a signal value to be applied to the one dot. It is possible to determine a signal value to be applied to the one dot with such a simple circuit construction.

In the third display device of the present invention, the first circuit is preferably realized by a bit shift circuit, thereby further simplifying the circuit construction.

In the third display device of the present invention, in order to compute a signal value applied to another dot, the control means preferably includes a third circuit for performing a power calculation and multiplication on each of the input signals to the defective dot and the plural dots, based on each predetermined value. With the circuit construction including the third circuit, it is possible to determine a signal value to be applied to another dot.

In the third display device of the present invention, the third circuit is preferably realized by a lookup table, thereby further simplifying the circuit construction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A display device that has a plurality of pixels, each pixel displaying by dots of at least three colors, said display comprising:

control means for controlling a signal applied to one or more dots adjacent to a defective dot in order to compensate for a display defect caused by the defective dot, which is electrically uncontrollable; and wherein control is exercised on a signal applied to n dots, where n is an integer of 1 or more, such that a sum of luminance of the n dots adjacent to the defective dot is virtually equal to a sum of an original luminance that is obtained by a signal inputted to the defective dot and the n dots, where the sum of the luminance and the sum of the original luminance are computed by taking into consideration relative brightness of respective colors of the dots.

2. The display device as defined in claim 1, wherein said color is represented by CIE (1976) L*a*b*color value.

3. The display device as defined in claim 1, wherein control is exercised on a signal applied to two of the dots adjacent to the defective dot.

4. The display device as defined in claim 1, further comprising:

an operation circuit that computes and outputs a signal value applied to a dot adjacent to the defective dot, based on an input signal, in order to compensate for a display defect caused by the defective dot, a switching circuit for receiving a first signal and a second signal and for switching an output between the first signal, which is transmitted from the operation circuit, and the second signal, which does not pass through said operation circuit, and an address detecting circuit for supplying a switching signal to said switching circuit at a timing of displaying a position of the defective dot on a display, wherein said switching circuit outputs the first signal at a timing of inputting the switching signal and outputs the second signal at a timing other than inputting the switching signal.

5. The display device as defined in claim 4, wherein said second signal is inputted via a delay circuit to said switching circuit.

6. The display device as defined in claim 1, wherein the input signals to the defective dot and n dots are signals of a linear luminance domain ($\gamma$=1).

7. A display device that has a plurality of pixels, each pixel displaying by dots of at least three colors, said display comprising:

control means for controlling a signal applied to one or more dots adjacent to a defective dot in order to compensate for a display defect caused by the defective dot, which is electrically uncontrollable; and wherein control is exercised on a signal applied to n dots, where n is an integer of 1 or more, so as to reduce a difference between a color obtained by illumination of the n dots adjacent to the defective dot and an original color obtained by a signal inputted to the defective dot and the n dots.

8. The display device as defined in claim 7, wherein control is exercised on a signal applied to the n dots so as to reduce CIE (1976) L*a*b*color difference between a color obtained by illumination of the n dots adjacent to the defective dot and an original color obtained by a signal inputted to the defective dot and the n dots.

9. The display device as defined in claim 7, wherein control is exercised on a signal applied to two of the dots adjacent to the defective dot.

10. The display device as defined in claim 7, further comprising:

an operation circuit that computes and outputs a signal value applied to a dot adjacent to the defective dot, based on an input signal, in order to compensate for a display defect caused by the defective dot, a switching circuit for receiving a first signal and a second signal and for switching an output between the first signal, which is transmitted from the operation circuit, and the second signal, which does not pass through said operation circuit, and an address detecting circuit for supplying a switching signal to said switching circuit at a timing of displaying a position of the defective dot on a display, wherein said switching circuit outputs the first signal at a timing of inputting the switching signal and outputs the second signal at a timing other than inputting the switching signal.

11. The display device as defined in claim 10, wherein said second signal is inputted via a delay circuit to said switching circuit.

12. The display device as defined in claim 7, wherein said control means controls a signal applied to the plurality of dots such that a sum of luminance of the plurality of dots is virtually equal to a sum of original luminance obtained by a signal inputted to the defective dot and the plurality of dots.

13. The display device as defined in claim 7, wherein the input signals to the defective dot and n dots are signals of a linear luminance domain ($\gamma$=1).

14. A display device that has a plurality of pixels, each pixel displaying by dots of at least three colors, said display comprising:

control means for controlling a signal applied to one or more dots adjacent to a defective dot in order to compensate for a display defect caused by the defective dot, which is electrically uncontrollable wherein control is exercised on a signal applied to n dots, where n is an integer of 1 or more, such that a color obtained by illumination of the n dots, which are adjacent to the defective dot, is closer to an average of an original color of a pixel including the defective dot and an original color of one or more pixels adjacent to the pixel.

15. The display device as defined in claim 14, wherein said color is represented by CIE (1976) L*a*b*color value.

16. The display device as defined in claim 14, wherein control is exercised on a signal applied to two of the dots adjacent to the defective dot.

17. The display device as defined in claim 14, further comprising:

an operation circuit which computes and outputs a signal value applied to a dot adjacent to the defective dot, based on an input signal, in order to compensate for a display defect caused by the defective dot, a switching circuit for receiving a first signal and a second signal and for switching an output between the first signal, which is transmitted from the operation circuit, and the second signal, which does not pass through said operation circuit, and an address detecting circuit for supplying a switching signal to said switching circuit at a timing of displaying a position of the defective dot on a display, wherein said switching circuit outputs the first signal at a timing of inputting the switching signal and outputs the second signal at a timing other than inputting the switching signal.

18. The display device as defined in claim 17, wherein said second signal is inputted via a delay circuit to said switching circuit.

19. The display device as defined in claim 14, further comprising:

an average color value computing circuit for computing an average color value of an original color of a pixel including the defective dot and an original color of one or more pixels adjacent to the pixel, and an output circuit for computing and outputting a signal value applied to the n dots such that a color obtained by illumination of the n dots is closer to an average color value obtained by said average color value computing circuit.

20. The display device as defined in claim 19, wherein said average color value computing circuit computes average values of respective color signals of a pixel including the defective dot and one or more pixels adjacent to the pixel, and computes an average color value based on these average values.

21. The display device as defined in claim 14, wherein said control means controls a signal applied to the plurality of dots such that a sum of luminance of the plurality of dots is virtually equal to a sum of original luminance obtained by a signal inputted to the defective dot and the plurality of dots.

22. The display device as defined in claim 14, wherein the input signals to the defective dot and n dots are signals of a linear luminance domain ($\gamma=1$).

23. A display device, which has a plurality of pixels, each pixel displaying by dots of at least three colors, comprising:

control means for controlling a signal applied to a plurality of dots adjacent to a defective dot such that a difference is reduced between a color obtained by illumination of the plurality of dots and an original color obtained by input signals to the defective dot and the plurality of dots, in order to compensate for a display defect caused by the defective dot which is electrically uncontrollable, wherein said control means performs an operation based on a function, which is obtained by a correlation relationship between an original input signal of the defective dot and a signal value to be applied to one of the plurality of dots in response to the input signal of the defective dot, so as to determine a signal value applied to the one of the plurality of dots, and then, said control means determines a signal value applied to another dot.

24. The display device as defined in claim 23, wherein an approximate straight line is used as said function, said approximate straight line being obtained by a correlation relationship between an original input signal of the defective dot and a signal value to be applied to the one of the plurality of dots in response to the input signal of the defective dot.

25. The display device as defined in claim 24, wherein inclination of said approximate straight line is determined according to an input signal value of the one of the plurality of dots.

26. The display device as defined in claim 25, wherein approximate values of 0 and $1/2^n$, where n is an integer of 0 or more, are used as the inclination of said approximate straight line.

27. The display device as defined in claim 24, wherein said control means includes:

a first circuit which determines inclination of said approximate straight line according to an input signal value of the one of the plurality of dots and multiplies the inclination by an input signal value of the defective dot; and a second circuit which adds the input signal value of the one of the plurality of dots to the value computed in said first circuit, and outputs a signal value to be applied to the one dot.

28. The display device as defined in claim 27, wherein said first circuit is realized by a bit shift circuit.

29. The display device as defined in claim 27, wherein in order to compute a signal value applied to another dot, said control means includes a third circuit for performing a power calculation and multiplication on each signal inputted to the defective dot and the plurality of dots, based on each predetermined value.

30. The display device as defined in claim 29, wherein said third circuit is realized by a lookup table.

31. The display device as defined in claim 23, wherein said color difference is represented by CIE (1976) L*a*b*color difference value.

32. The display device as defined in claim 23, wherein said control means controls a signal applied to the plurality of dots such that a sum of luminance of the plurality of dots is virtually equal to a sum of original luminance obtained by a signal inputted to the defective dot and the plurality of dots.

33. The display device as defined in claim 23, wherein the input signals to the defective dot and the plurality of dots are signals of a linear luminance domain ($\gamma=1$).

* * * * *